US009293232B2

(12) United States Patent
In et al.

(10) Patent No.: US 9,293,232 B2
(45) Date of Patent: Mar. 22, 2016

(54) COMPOSITE CONDUCTOR AND ELECTRIC WIRE USING THE SAME

(71) Applicants: DYDEN CORPORATION, Kurume-shi, Fukuoka (JP); FUKUOKA PREFECTURAL GOVERNMENT, Fukuoka-shi, Fukuoka (JP); NATIONAL UNIVERSITY CORPORATION KUMAMOTO UNIVERSITY, Kumamoto-shi, Kumamoto (JP)

(72) Inventors: Hiroyuki In, Kurume (JP); Fumiyo Annou, Kurume (JP); Daisuke Matsunaga, Kurume (JP); Hiromoto Kitahara, Kumamoto (JP); Shinji Ando, Kumamoto (JP); Masayuki Tsushida, Kumamoto (JP); Toshifumi Ogawa, Kitakyushu (JP)

(73) Assignees: DYDEN CORPORATION, Kurume-shi (JP); FUKUOKA PREFECTURAL GOVERNMENT, Fukuoka-shi (JP); NAT'L UNIVERSITY CORPORATION KUMAMOTO UNIVERSITY, Kumamoto-shi (JP)

( * ) Notice: Subject to any disclaimer, the term of this patent is extended or adjusted under 35 U.S.C. 154(b) by 93 days.

(21) Appl. No.: 14/362,868

(22) PCT Filed: Dec. 6, 2012

(86) PCT No.: PCT/JP2012/081688

§ 371 (c)(1),
(2) Date: Jun. 4, 2014

(87) PCT Pub. No.: WO2013/085003

PCT Pub. Date: Jun. 13, 2013

(65) Prior Publication Data

US 2014/0311769 A1 Oct. 23, 2014

(30) Foreign Application Priority Data

Dec. 7, 2011 (JP) ..... 2011-268122

(51) Int. Cl.

| | |
|---|---|
| ***H01B 1/02*** | (2006.01) |
| ***C22C 5/06*** | (2006.01) |
| ***C22C 9/00*** | (2006.01) |
| ***C22C 21/00*** | (2006.01) |
| ***C22F 1/00*** | (2006.01) |
| ***C22F 1/04*** | (2006.01) |
| ***C22F 1/08*** | (2006.01) |
| ***C22C 5/08*** | (2006.01) |
| ***C22C 9/04*** | (2006.01) |

(52) U.S. Cl.
CPC *H01B 1/026* (2013.01); *C22C 5/06* (2013.01); *C22C 5/08* (2013.01); *C22C 9/00* (2013.01);
(Continued)

(58) Field of Classification Search
CPC ..... H01B 1/026; H01B 1/023; C22C 5/06; C22C 9/00; C22C 21/00; C22C 5/08; C22C 9/04; C22F 1/00; C22F 1/04; C22F 1/08; Y10T 428/12889
USPC ..... 174/126.2; 428/615, 652, 672, 675
See application file for complete search history.

(56) References Cited

U.S. PATENT DOCUMENTS

2003/0037957 A1* 2/2003 Ueno ..... H01B 7/0009 174/128.1
2010/0075168 A1* 3/2010 Schaffer ..... A61L 31/022 428/544

(Continued)

FOREIGN PATENT DOCUMENTS

CN 201069826 * 6/2008
EP 2 728 586 A1 5/2014

(Continued)

OTHER PUBLICATIONS

International Search Report dated Feb. 26, 2013 issued in corresponding application No. PCT/JP2012/081688.

*Primary Examiner* — Timothy Thompson
*Assistant Examiner* — Charles Pizzuto
(74) *Attorney, Agent, or Firm* — Westerman, Hattori, Daniels & Adrian, LLP

(57) ABSTRACT

A composite conductor 10, including an internal layer 11 having a conductive material A, the conductive material A having fatigue strength of at least 150 MPa after being subjected to $10^6$ cycles of cyclic loading in a fatigue test, and an external layer 12 having a conductive material B, the external layer coating the internal layer 11, the conductive material B having tensile strength higher than that of the conductive material A, the tensile strength being at least 250 MPa, in which the composite conductor 10 has fracture resistance to a sudden load and impact as well as bending durability.

16 Claims, 3 Drawing Sheets

(52) U.S. Cl.
CPC . *C22C 9/04* (2013.01); *C22C 21/00* (2013.01); *C22F 1/00* (2013.01); *C22F 1/04* (2013.01); *C22F 1/08* (2013.01); *H01B 1/023* (2013.01); *Y10T 428/1275* (2015.01); *Y10T 428/1291* (2015.01); *Y10T 428/12493* (2015.01); *Y10T 428/12889* (2015.01)

(56) References Cited

U.S. PATENT DOCUMENTS

| | | | | |
|---|---|---|---|---|
| 2012/0062154 | A1* | 3/2012 | Chiao | H02K 3/47 318/161 |
| 2013/0025339 | A1* | 1/2013 | Costa | B21F 45/008 72/127 |

FOREIGN PATENT DOCUMENTS

| | | | |
|---|---|---|---|
| JP | 60-136104 | A | 7/1985 |
| JP | 61-7507 | A | 1/1986 |
| JP | 5-267090 | A | 10/1993 |
| JP | 5-290629 | A | 11/1993 |
| JP | 9-17237 | A | 1/1997 |
| JP | 2004-281241 | A | 10/2004 |
| JP | 2010-157363 | A | 7/2010 |
| JP | 2010-280969 | A | 12/2010 |
| WO | 2013/002271 | A1 | 1/2013 |
| WO | 2013/002272 | A1 | 1/2013 |

* cited by examiner

COMPOSITE CONDUCTOR AND ELECTRIC WIRE USING THE SAME

TECHNICAL FIELD

The present invention relates to a bending-resistant composite conductor and an electric wire using the same. For example, the composite conductor and the electric wire are used for wiring of drive members for industrial robots and wiring of transporting machines such as automobiles and aircrafts.

BACKGROUND ART

Conventionally, a cable used for wiring of a drive member for an industrial robot depends solely on a pure copper conductor, and bending durability required as the cable for the robot is ensured in terms of both (i) a cable design technique in which a combined structure of strands of the pure copper conductor is optimized and (ii) a cable manufacturing technique in which a diameter of the pure copper conductor is decreased to an optimal diameter by a wire drawing method and the pure copper conductor is coated with a optimally-selected polymer coating material. With a recent increase in speed of motions of the robot, there is a strong need to make the cable for the robot lighter in addition to the bending durability.

Patent Literature 1 discloses, as a copper or copper alloy clad aluminium alloy wire that is lightweight and highly conductive and has better wire drawing workability than a copper clad aluminium wire, a copper or copper alloy clad aluminium alloy wire including (i) a core made of a high aluminium alloy wire (e.g., Al-0.4Mg-0.4Si) with tensile strength of 24 kgf/mm$^2$ or more and a conductivity of 58% IACS or more and (ii) a copper or copper alloy layer coating the core with a stacking factor of 10 to 20%.

Patent Literature 2 discloses, as a conductor used for an electric wire for an automobile, made of a copper clad aluminium composite strand lighter than a copper wire, and has good flexibility and good tensile strength, a conductor including (i) a core made of an aluminium-magnesium alloy containing 2.2 to 5.6 mass % magnesium, (ii) an intermediate layer made of copper or a copper alloy, which is laminated on an external side of the core, and (iii) a reinforcement layer made of nickel or a nickel alloy, which is laminated on an external side of the intermediate layer. A diameter of the whole conductor is 1.5 mm or less. A cross sectional area of the reinforcement layer is 3 to 10% of that of the whole conductor.

Patent Literature 3 discloses, as a copper clad aluminium alloy wire having flexibility, workability, good wire drawing workability, high conductivity, and tensile strength, a copper clad aluminium alloy wire including an aluminium alloy wire coated with copper, in which the aluminium alloy wire is made of an aluminium alloy, containing 0.2 to 0.8 mass % Si, 0.36 to 1.5 mass % Fe, 0.2 mass % or less Cu, 0.45 to 0.9 mass % Mg, 0.005 to 0.03 mass % Ti, and Al and inevitable impurities for the rest.

CITATION LIST

Patent Literature

Patent Literature 1: Japanese Unexamined Patent Application Publication No. H9-17237

Patent Literature 2: Japanese Unexamined Patent Application Publication No. 2010-157363

Patent Literature 3: Japanese Unexamined Patent Application Publication No. 2010-280969

SUMMARY OF INVENTION

Technical Problem

For example, if a motion of a robot takes two seconds, the number of the motions of the robot in a 30-day continuous operation exceeds a million times. When a bending durability test (in which a specimen is subjected to a 100-g load, a bending radius is 15 mm, and a range of bending angle is ±90 degrees) is conducted on each of the aluminium alloy wires disclosed in Patent Literatures 1 and 3 and the core made of an aluminium-magnesium alloy disclosed in Patent Literature 2, the number of cycles to fracture is approximately 300,000 to 500,000 times. When the same bending durability test is conducted on, for example, the copper forming each of covering layers disclosed in Patent Literatures 1 and 3 and the intermediate layer disclosed in Patent Literature 2, the number of cycles to fracture is approximately 500,000 to 1,000,000 times. When the same bending durability test is conducted on, for example, the nickel forming the reinforcement layer disclosed in Patent Literature 2, the number of cycles to fracture is approximately 2,000,000 to 5,000,000 times. Accordingly, the cable for the robot manufactured by the aluminium alloy wire and the conductor disclosed in Patent Literatures 1 to 3 does not have sufficient bending durability (e.g., the number of cycles to fracture of more than 5,000,000 times), and the robot can not be stably operated for a long period.

In an actual operation of the robot, a sudden load or impact may act on the robot. If the sudden load or impact acts on the cable for the robot, a defect (microcrack) is likely generated on a surface layer of the cable, and the microcrack generated increases a probability of the fracture of the cable for the robot. As a result, design performance (design life) of the cable can not be achieved.

The present invention has been made in view of the above circumstances and it is an object of the present invention to provide a composite conductor and an electric wire using the same, in which the composite conductor has fracture resistance to a sudden load or impact and high bending durability.

Solution to Problem

To accomplish the above object, a first aspect of the present invention provides a composite conductor, including: an internal layer including a conductive material A, the conductive material A having fatigue strength of at least 150 MPa after being subjected to $10^6$ cycles of cyclic loading in a fatigue test; and an external layer including a conductive material B, the external layer coating the internal layer, the conductive material B having tensile strength higher than that of the conductive material A, the tensile strength being at least 250 MPa; wherein the composite conductor has fracture resistance to a sudden load and impact as well as bending durability.

To meet a requirement of "fracture resistance to a sudden load and impact as well as bending durability," the composite conductor needs to bear 3,000,000 to 5,000,000 times or more (it varies depending on materials) of dynamic driving tests.

In the first aspect of the present invention, the conductive material A can include a metal texture including (i) a crystal grain of aluminium or an aluminium-based alloy, the crystal grain having an average grain size of 2 μm or less (e.g., 0.5 μm or more, preferably 1 μm or more), and (ii) a nanoparticle C existing in a grain boundary between the crystal grains, and wherein the conductive material B comprises a metal texture including a crystal grain of copper or a copper-based alloy, the crystal grain having an average grain size of 2 μm or less (e.g., 0.5 μm or more, preferably 1 μm or more).

Preferably, the nanoparticle C is any one of fullerene, carbon nanotube, a silicon nanoparticle, a transition metal nanoparticle, and a compound nanoparticle including a compound of a metal forming the conductive material A, the nanoparticle C being 0.1 mass % or more but not exceeding 20 mass %.

In addition, the nanoparticle C can be a nanoscale aluminium-scandium precipitate, the nanoscale precipitate being 0.1 mass % or more but not exceeding 1 mass %.

Preferably, the conductive material A comprises the aluminium-based alloy and the aluminium-based alloy further comprises 0.1 mass % or more but not exceeding 0.2 mass % of zirconium.

Preferably, the metal texture of the conductive material A comprises 20% or more of the crystal grains by cross sectional area with a grain size of 1 μm or less.

In the first aspect of the present invention, the conductive material A can include a metal texture including a crystal grain of copper, the crystal grain having an average grain size of 2 μm or less, wherein the conductive material B comprises a metal texture including a crystal grain of a copper-based alloy, the crystal grain having an average grain size of 2 μm or less, and wherein a strength ratio $\sigma_B/\sigma_A$ of tensile strength $\sigma_B$ of the conductive material B to tensile strength $\sigma_A$ of the conductive material A is 1.6 or more.

Preferably, 0.1 mass % or more but not exceeding 20 mass % of a nanoparticle D exists in a grain boundary of the crystal grains in the metal texture forming the conductive material B.

In addition, the nanoparticle D can be fullerene, carbon nanotube, a silicon nanoparticle, a transition metal nanoparticle, or a compound nanoparticle including a compound of a metal forming the conductive material B.

In the first aspect of the present invention, the conductive material B can include the copper-based alloy, and the copper-based alloy is any one of a copper silver alloy, a copper tin alloy, and a copper nickel alloy.

To accomplish the above object, a second aspect of the present invention provides a composite conductor, including: an internal layer including a conductive material A, the conductive material A having fatigue strength of at least 150 MPa after being subjected to $10^6$ cycles of cyclic loading in a fatigue test; and an external layer including a conductive material B, the external layer coating the internal layer, the conductive material B having tensile strength higher than that of the conductive material A, the tensile strength being at least 150 MPa; wherein the composite conductor has bending durability. Thus, the composite conductor bears 3,000,000 times or more of the dynamic driving tests.

In the second aspect of the present invention, the conductive material A can include a metal texture including (i) a crystal grain of aluminium, the crystal grain having an average grain size of 2 μm or less, and (ii) a nanoscale aluminium-scandium precipitate, the nanoscale precipitate being 0.1 mass % or more but not exceeding 1 mass % and wherein the conductive material B comprises a metal texture including a crystal grain of silver or a silver-based alloy, the crystal grain having an average grain size of 2 μm or less.

The conductive material A can include a metal texture including a crystal grain of copper or a copper-based alloy, the crystal grain having an average grain size of 2 μm or less, and wherein the conductive material B comprises a metal texture including a crystal grain of silver or a silver-based alloy, the crystal grain having an average grain size of 2 μm or less.

In the second aspect of the present invention, the conductive material A can include a metal texture including (i) a crystal grain of aluminium or an aluminium-based alloy, the crystal grain having an average grain size of 2 μm or less, and (ii) a nanoparticle C existing in a grain boundary between the crystal grains, wherein the conductive material B comprises a metal texture including a crystal grain of silver or a silver-based alloy, the crystal grain having an average grain size of 2 μm or less, and wherein the nanoparticle C is any one of fullerene, carbon nanotube, a silicon nanoparticle, a transition metal nanoparticle, and a compound nanoparticle including a compound of a metal forming the conductive material A, the nanoparticle C being 0.1 mass % or more but not exceeding 20 mass %.

To accomplish the above object, a third aspect of the present invention provides an electric wire made of the composite conductor according to the first aspect of the present invention, including: a composite strand having a diameter of 0.05 mm or more but not exceeding 0.5 mm, wherein the electric wire is utilized as an electric wire for wiring a drive member for a robot.

To accomplish the above object, a fourth aspect of the present invention provides an electric wire made of the composite conductor according to the second aspect of the present invention, including: a composite strand having a diameter of 0.05 mm or more but not exceeding 0.5 mm, wherein the electric wire is utilized as an electric wire for wiring an automobile or an aircraft.

Advantageous Effects of Invention

In the composite conductor according to the first aspect of the present invention, a fatigue failure of the composite conductor is caused by a fatigue crack, which grows from the defect (microcrack) on the surface layer of the external layer and propagates from the external layer to the internal layer. Since the tensile strength of the conductive material B forming the external layer is at least 250 MPa, the microcrack (defect), which is a starting point of the fatigue crack, can be prevented from being generated on the surface layer (external layer) of the composite conductor, for example, even when a possible sudden load fluctuation or impact from outside acts on the composite conductor in practical use of the industrial robot. Since the fatigue strength of the conductive material A, which is subjected to $10^6$ cycles of the cyclic loading in the fatigue test and forms the internal layer, is at least 150 MPa, the conductive material A can surely bear, for example, 3,000,000 to 5,000,000 times or more (it varies depending on materials) of the dynamic driving tests. Thus, the composite conductor can be used for a material for wiring the drive member for the industrial robot.

In the composite conductor according to the first aspect of the present invention, when the conductive material A is formed by the metal texture including (i) the crystal grain of the aluminium or the aluminium-based alloy having the average grain size of 2 μm or less and (ii) the nanoparticle C existing in the grain boundary between the crystal grains, the fatigue crack propagating in the conductive material A frequently clashes with the crystal grains and deflection and bifurcation of the fatigue crack are enhanced, thereby reducing a rate of the fatigue crack growing in one direction. When the fatigue crack clashes with the nanoparticle C, the fatigue crack is pinned by the nanoparticle C, thereby further reducing the growth rate of the fatigue crack. Accordingly, a length of the fatigue crack generated in the conductive material A becomes short, and the fatigue strength of the conductive material A subjected to $10^6$ cycles of the cyclic loading can be at least 150 MPa.

When the conductive material B is formed by the metal texture including the crystal grain of the copper or the copper-based alloy with the average grain size of 2 μm or less, a requirement that the tensile strength be at least 250 MPa can be easily achieved. In this case, the number of layers of the crystal grains forming the external layer becomes 2 or more, thus the generation of the crack penetrating the external layer can be avoided even when a sudden load fluctuation or impact acts on the external layer from outside.

In the composite conductor according to the first aspect of the present invention, when the composite conductor contains 0.1 mass % or more but not exceeding 20 mass % of the nanoparticle C, in which the nanoparticle C is the fullerene, the carbon nanotube, the silicon nanoparticle, the transition metal nanoparticle, or the compound nanoparticle including the compound of the metal forming the conductive material A, characteristics of the conductive material A can be optimized depending on property and usage.

It is not preferable that the nanoparticle C be less than 0.1 mass %, because an amount of the nanoparticle C becomes too small to pin the fatigue crack effectively. Further, it is not preferable that the nanoparticle C exceed 20 mass %, because the nanoparticles C existing in the grain boundary is increased. In this case, the pinning effect to pin the fatigue crack is improved, but the conductivity is significantly decreased and a function as the conductive material is declined.

In the composite conductor according to the first aspect of the present invention, when the nanoparticle C is the nanoscale aluminium-scandium precipitate, the nanoscale precipitate can suppress grain growth of the crystal grains in the metal texture forming the internal layer. Thus, the average grain size of the crystal grains can be easily controlled to be 2 μm or less.

When the nanoscale precipitate is 0.1 mass % or more but not exceeding 1 mass %, the pinning effect to pin the crack is achieved while the conductivity of the conductive material A is prevented from decreasing. It is not preferable that the nanoscale precipitate be less than 0.1 mass %, because the pinning effect to pin the fatigue crack is decreased. Further, it is not preferable that the nanoscale precipitate exceed 1.0 mass %, because the nanoscale precipitate existing in the grain boundary is increased and the conductivity is decreased.

In the composite conductor according to the first aspect of the present invention, when the aluminium-based alloy includes 0.1 mass % or more but not exceeding 0.2 mass % of the zirconium, the zirconium existing in the crystal grain of the conductive material A and in the grain boundary can prevent the tensile strength from decreasing even if the internal layer is affected by thermal history of high temperature. It is not preferable that a contained amount of the zirconium be less than 0.1 mass %, because the tensile strength can not be prevented from decreasing. Further, it is not preferable that the contained amount of the zirconium exceed 0.2 mass %, because the conductivity is decreased.

In the composite conductor according to the first aspect of the present invention, when the metal texture of the conductive material A includes 20% or more of the 1 μm or less crystal grains by cross sectional area, a frequency of collisions between the fatigue crack propagating in the metal texture of the conductive material A and the crystal grain is increased, thereby further enhancing the deflection and the bifurcation of the fatigue crack. Accordingly, a growth resistance of the fatigue crack becomes large and the growth rate of the fatigue crack can be further decreased.

In the composite conductor according to the first aspect of the present invention, when the conductive material A is formed by the metal texture including the crystal grain of the copper having the average grain size of 2 μm or less, the fatigue crack propagating in the conductive material A frequently clashes with the crystal grains, thereby enhancing the deflection and the bifurcation of the fatigue crack. Accordingly, the rate of the fatigue crack growing in one direction is decreased, and the length of the fatigue crack generated in the conductive material A becomes short. Thus, the requirement that the fatigue strength of the conductive material A subjected to $10^6$ cycles of the cyclic loading be at least 150 MPa can be easily achieved.

When the conductive material B is formed by the metal texture including the crystal grain of the copper-based alloy having the average grain size of 2 μm or less, the requirement that the tensile strength be at least 250 MPa can be easily achieved. In this case, the number of layers of the crystal grains forming the external layer becomes 2 or more, thus the generation of the crack penetrating the external layer can be avoided even when a sudden load fluctuation or impact acts on the external layer from outside. When the strength ratio $\sigma_B/\sigma_A$ of the tensile strength $\sigma_B$ of the conductive material B to the tensile strength $\sigma_A$ of the conductive material A is 1.6 or more, in which the conductive materials A and B are copper materials, both of the requirements that (i) the fatigue strength of the conductive material A subjected to $10^6$ cycles of the cyclic loading be at least 150 MPa and (ii) the tensile strength of the conductive material B be at least 250 MPa can be achieved at the same time.

In the composite conductor according to the first aspect of the present invention, when 0.1 mass % or more but not exceeding 20 mass % of the nanoparticle D exists in the grain boundary of the crystal grains in the metal texture forming the conductive material B, the crack growing along the grain boundary can be pinned by the nanoparticle D, thereby decreasing the growth rate of the crack. When the nanoparticle D is less than 0.1 mass %, the amount of the nanoparticles D is too small to pin the fatigue crack effectively. It is not preferable that the nanoparticle D exceed 20 mass %, because the number of nanoparticle D existing in the grain boundary becomes large and ductility of the conductive material B is reduced.

In the composite conductor according to the first aspect of the present invention, when the nanoparticle D is the fullerene, the carbon nanotube, the silicon nanoparticle, the transition metal nanoparticle, or the compound nanoparticle including the compound of the metal forming the conductive material B, characteristics of the conductive material B can be optimized depending on property and usage.

In the composite conductor according to the first aspect of the present invention, when the conductive material B includes the copper-based alloy that is any one of the copper silver alloy, the copper tin alloy, and the copper nickel alloy, subsidiary characteristics of the composite conductor, such as conductivity with terminals and solderability, can be improved.

In the composite conductor according to the second aspect of the present invention, the fatigue failure of the composite conductor is caused by the fatigue crack, which grows from the defect (microcrack) on the surface layer of the external layer and propagates from the external layer to the internal layer. Since the external layer is formed by the conductive material B with the tensile strength of at least 150 MPa, the internal layer can be protected in practical use. Since the internal layer is formed by the conductive material A having the fatigue strength of at least 150 MPa after being subjected to $10^6$ cycles of the cyclic loading in the fatigue test, the conductive material A can surely bear, for example, three million times or more of the dynamic driving tests. Thus, the composite conductor can be used as a material for wiring of transporting machines such as an automobile and an aircraft, on which low-frequency oscillation acts constantly.

In the composite conductor according to the second aspect of the present invention, when the conductive material A is formed by the metal texture including (i) the crystal grains of the aluminium having the average grain size of 2 μm or less and (ii) 0.1 mass % or more but not exceeding 1 mass % of the nanoscale aluminium-scandium precipitates existing in the grain boundary between the crystal grains, the fatigue crack propagating in the conductive material A frequently clashes with the crystal grains, the deflection and the bifurcation of the fatigue crack are enhanced and a rate of the fatigue crack growing in one direction is decreased. When the fatigue crack clashes with the nanoscale precipitate, the fatigue crack is pinned by the nanoscale precipitate and the growth rate of the fatigue crack is further decreased. Accordingly, a length of the fatigue crack generated in the conductive material A becomes short, and the fatigue strength of the conductive material A subjected to $10^6$ cycles of the cyclic loading can be at least 150 MPa. It is not preferable that the nanoscale precipitate be less than 0.1 mass %, because the pinning effect to pin the fatigue crack is decreased. Further, it is not preferable that the nanoscale precipitate exceed 1 mass %, because the nanoscale precipitate existing in the grain boundary is increased and the conductivity is reduced.

When the conductive material B is formed by the metal texture including the crystal grain of the silver or the silver-based alloy having the average grain size of 2 μm or less, a requirement that the tensile strength is at least 150 MPa can be easily achieved. In this case, the number of layers of the crystal grains forming the external layer becomes 2 or more, thus the generation of the crack penetrating the external layer can be avoided. Since the conductive material B is the silver or the silver-based alloy, subsidiary characteristics of the composite conductor, such as conductivity with terminals and solderability, can be improved.

In the composite conductor according to the second aspect of the present invention, when the conductive material A contains the metal texture including the crystal grain of the copper or the copper-based alloy having an average grain size of 2 μm or less, the fatigue crack propagating in the conductive material A frequently clashes with the crystal grains, thereby enhancing the deflection and the bifurcation of the fatigue crack. Accordingly, a rate of the fatigue crack growing in one direction is decreased, and a length of the fatigue crack generated in the conductive material A becomes short. Thus, the requirement that the fatigue strength of the conductive material A subjected to $10^6$ cycles of the cyclic loading be at least 150 MPa can be easily achieved. Since the conductive material A is the copper or the copper-based alloy, the internal layer can be formed by a recycled material and a price reduction is possible.

When the conductive material B is formed by the metal texture including the crystal grain of the silver or the silver-based alloy having the average grain size of 2 μm or less, a requirement that the tensile strength be at least 150 MPa can be easily achieved. In this case, the number of layers of the crystal grains forming the external layer becomes 2 or more, thus the generation of the crack penetrating the external layer can be controlled. Since the conductive material B is the silver or the silver-based alloy, subsidiary characteristics of a composite conductor, such as conductivity with terminals and solderability, can be improved. Also, an improvement of transmission characteristics of high-frequency signals associated with skin effect can be achieved with a comparatively little amount use of silver.

In the composite conductor according to the second aspect of the present invention, when the conductive material A is formed by the metal texture including (i) the crystal grain of the aluminium or the aluminium-based alloy having the average grain size of 2 μm or less and (ii) the nanoparticle C existing in the grain boundary between the crystal grains, the fatigue crack propagating in the conductive material A frequently clashes with the crystal grains, the deflection and the bifurcation of the fatigue crack are enhanced, thereby decreasing a rate of the fatigue crack growing in one direction. When the fatigue crack clashes with the nanoparticle C, the fatigue crack is pinned by the nanoparticle C, thereby further decreasing the growth rate of the fatigue crack. Accordingly, a length of the fatigue crack generated in the conductive material A becomes short, and the fatigue strength of the conductive material A subjected to $10^6$ cycles of the cyclic loading can be at least 150 MPa.

When the conductive material B is formed by the metal texture including the crystal grain of the copper or the copper-based alloy having the average grain size of 2 μm or less, a requirement that the tensile strength be at least 150 MPa can be easily achieved. In this case, the number of layers of the crystal grains forming the external layer becomes 2 or more, thus the generation of the crack penetrating the external layer can be avoided even when a sudden load fluctuation or impact acts on the external layer from outside.

When the composite conductor contains 0.1 mass % or more but not exceeding 20 mass % of the nanoparticle C, which is the fullerene, the carbon nanotube, the silicon nanoparticle, the transition metal nanoparticle, or the compound nanoparticle including the compound of the metal forming the conductive material A, characteristics of the conductive material A can be optimized depending on property and usage. It is not preferable that the nanoparticle C be less than 0.1 mass %, because an amount of the nanoparticle C is too small to pin the fatigue crack effectively. Further, it is not preferable that the nanoparticle C exceed 20 mass %, because the nanoparticle C existing in the grain boundary is increased. In this case, the pinning effect to pin the fatigue crack is improved, but the conductivity is significantly decreased and a function as the conductive material is declined.

The electric wire according to the third aspect of the present invention is formed by a composite strand, which is made of the composite conductor according to the first aspect of the present invention and has a diameter of 0.05 mm or more but not exceeding 0.5 mm. In this case, a strain (deformation) of the composite strand caused when the cyclic bending load is applied to the electric wire can be reduced, and a defect is prevented from being generated on the surface layer of the composite strand even when a sudden load or impact acts on the composite strand and thus an early breaking of the electric wire can be avoided. Thus, when the electric wire is used for wiring of a drive member for a robot, reliability of the robot can be improved and maintenance costs can be reduced.

The electric wire according to the fourth aspect of the present invention is formed by a composite strand, which is made of the composite conductor according to the second aspect of the present invention and has a diameter of 0.05 mm or more but not exceeding 0.5 mm. In this case, a strain (deformation) of the composite strand caused when the cyclic bending load is applied to the electric wire can be reduced, and a defect is prevented from being generated on the surface layer of the composite strand even when a sudden load or impact acts on the composite strand and thus the breaking of the electric wire can be avoided at an early stage. Thus, when the electric wire is used for wiring of an automobile or an aircraft, reliability of the automobile or the aircraft can be improved and maintenance costs can be reduced.

DESCRIPTION OF EMBODIMENTS

Referring to the accompanying drawings, embodiments of the present invention will be described for a better understanding of the present invention.

Figure 1:
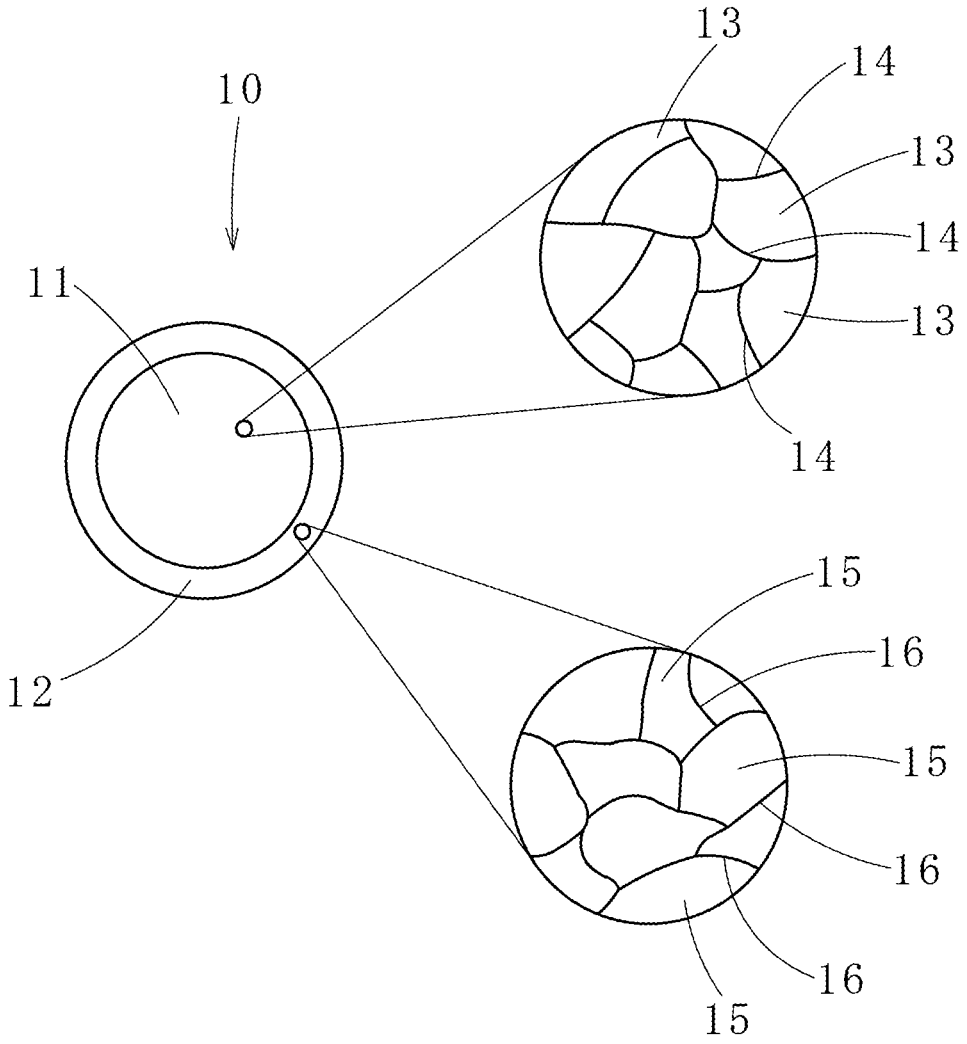
FIG. 1 is an explanatory diagram showing a texture of a composite conductor according to a first embodiment of the present invention.

As shown in FIG. 1, a composite conductor 10 according to a first embodiment of the present invention includes an internal layer 11 made of aluminium which is an example of conductive materials A, and an external layer 12 coating the internal layer 11 and being made of copper silver alloy which is an example of copper-based alloy forming conductive materials B. The conductive material A has fatigue strength of at least 150 MPa after being subjected to $10^6$ cycles of cyclic loading in a fatigue test. The conductive material B has tensile strength of at least 250 MPa, which is higher than tensile strength of aluminium.

The aluminium includes a metal texture containing aluminium grains 13 with an average grain size of 2 μm or less and less than 0.3 mass % inevitable impurities, for example. A part of the inevitable impurities is dissolved in the crystal grains 13 and the rest thereof exists in a grain boundary 14. When the average grain size of the crystal grains 13 is controlled to be 2 μm, as observed through a microscopic observation of the metal texture, a maximum grain size of the crystal grain 13 in the metal texture is 4 μm and the fatigue strength of the aluminium subjected to $10^6$ cycles of the cyclic loading in the fatigue test is 150 MPa. When the crystal grains 13 with a grain size of 1 μm or less constitutes 20% of the cross sectional area of the metal texture, the average grain size of the crystal grains 13 is 1.5 μm and the fatigue strength of the aluminium subjected to $10^6$ cycles of the cyclic loading in the fatigue test is 200 MPa. When the crystal grains 13 with a grain size of 1 μm or less constitutes 50% of the cross sectional area of the metal texture, the average grain size of the crystal grains 13 is 1.2 μm and the fatigue strength of the aluminium subjected to $10^6$ cycles of the cyclic loading in the fatigue test is 220 MPa.

The copper silver alloy includes 1 mass % or more but not exceeding 10 mass % silver, and includes copper and inevitable impurities (e.g., a contained amount of the inevitable impurities is 0.1-0.35 mass %) for the rest. The copper silver alloy includes a metal texture, containing crystal grains 15 having an average grain size of 2 μm or less. A part of the inevitable impurities is dissolved in the crystal grains 15 and the rest thereof exists in a grain boundary 16. When the average grain size of the crystal grains 15 is controlled to be 2 μm or less, as observed through the microscopic observation of the metal texture, a maximum grain size of the crystal grain 15 in the metal texture is 4 μm and the fatigue strength is 450 MPa.

A thickness of the external layer 12 is determined in each case depending on intended purposes and demand characteristics (e.g., a range of values of electric conductivity and a range of values of fatigue strength) of the composite conductor 10. When the composite conductor 10 is circular in cross section, a ratio of the thickness of the external layer 12 to a diameter of the internal layer 11 is normally within a range of 0.05 to 0.2 (the same applies hereinafter). For example, when a diameter of the composite conductor 10 is 120 μm, 80 μm, and 50 μm, the thickness of the external layer 12 is 5 to 20 μm, 5 to 15 μm, and 5 to 10 μm, respectively. When the average grain size of the crystal grains 15 forming the external layer 12 is controlled to be 2 μm or less, the metal texture of the external layer 12 can be formed by the crystal grains 15 with the maximum grain size of 4 μm, and the external layer 12 can be formed by two or more layers of the crystal grains IS. Thus, even when an external force acts on the external layer 12, the generation of the crack penetrating the external layer 12 can be avoided.

Hereinafter, a description will be given on a method of manufacturing the composite conductor 10.

Aluminium with a purity of 99.9 mass % or more is made into a block of a conductive material for the internal layer, and the block of the conductive material is processed into a rod with a diameter of, for example, 10 mm by cutting work. Copper with a purity of 99.9 mass % or more and silver with a purity of 99 mass % or more are cast into a block of conductive material of a copper silver alloy containing 1 to 10% silver for the external layer, and the block of the conductive material is processed into a tape material with a thickness of, for example, 1 mm. After the rod and the tape material are cleaned by a wash treatment, the tape material is placed on an external side of the rod such that the tape material and the rod are arranged concentrically to make a composite rod that is the rod coated with the tape material. A process of coating the rod with the tape material is performed under a controlled atmosphere to avoid oxidation of a surface of the rod. If needed, after the tape material and the rod are arranged concentrically, butts (ends) of the tape material can be continuously welded by gas welding and the like to make the tape material in a cylindrical shape.

By a pressure (e.g., 100 to 1000 MPa) applied to the composite rod (the tape material) from an outer circumference thereof, the rod and the tape material are pressure-welded (integrated) mechanically. The composite rod, i.e., the integration of rod and tape material, is rolled and processed into a wire with an external diameter of, for example, 1 to 2 mm. The wire is heat-treated at 300 to 500° C. for 0.1 to 5 hours, for example, at 350° C. for 1 hour. The heat-treatment enhances formation of isometric crystals, thus the average grain size is minified and a probability of formation of a fine crystal grain with a grain size of 1 μm or less is increased. As a result, the composite conductor 10 including (i) the internal layer 11 containing crystal grains of aluminium with an average grain size of 2 μm or less and (ii) the external layer 12 containing crystal grains of copper-based alloy with an average grain size of 2 μm or less is made. The composite conductor 10 is pulled through wire drawing dies and processed into a composite strand with a diameter of 0.05 mm or more but not exceeding 0.5 mm, and then the composite strands are processed into a stranded wire to manufacture an electric wire.

When the rod and the tape material are integrated, one or both of the rod and the tape material can be heated (e.g., heated to a temperature equivalent to 40 to 70% of a melting point of the rod or the tape material). The application of heat enhances a plastic deformation, thereby accelerating the pressure welding of the rod and the tape material. The composite rod can be heated in a heating furnace, or the heat can be generated in the composite rod by applying an electric current. Further, the internal layer 11 and the external layer 12 forming the composite conductor 10 can be integrated via a fusion layer by inserting a metal fusion material such as an insert material (e.g., an alloy bond made of a brazing filler material, etc.) between the rod and the tape material. The fusion layer between the internal layer 11 and the external layer 12 enhances the integral formation.

Provided that a cross sectional area of unprocessed material is $S_0$ and a cross sectional area of processed material is $S_1$, a processing rate is defined as $\ln(S_0/S_1)$. The processing rate in which the composite rod is rolled into the wire is set to 3 to 4, the heat treatment (e.g., a heat treatment temperature is equivalent to 30 to 70% of a melting point of the rod) is performed to accelerate the formation of the isometric crystals, and the processing rate in which the wire is pulled through the wire drawing dies and processed into the composite strand is set to 4 to 6, preferably to 5 to 6. In this case, the average grain size of the crystal grains 13 forming the metal texture of the internal layer 11 is 2 μm, and the average grain size of the crystal grains 15 forming the metal texture of the external layer 12 is 2 μm. Further, the processing rate in which the composite rod is rolled into the wire is set to 3 to 4, and the processing rate in which the wire is pulled through the wire drawing dies is set to 4 to 7, preferably 6.5 to 7. In this case, the average grain size of the crystal grains 13 forming the metal texture of the internal layer 11 is 1.5 μm, the cross sectional ratio of the crystal grains 13 with the grain size of 1 μm or less is 20%, and the average grain size of the crystal grains 15 forming the metal texture of the external layer 12 is 2 μm or less. Still further, the processing rate in which the composite rod is rolled into the wire is set to 3 to 4, and the processing rate in which the wire is pulled through the wire drawing dies is set to 5 to 8, preferably more than 7 but 8 or less. In this case, the average grain size of the crystal grains 13 forming the metal texture of the internal layer 11 is 1.2 μm, the cross sectional ratio of the crystal grains 13 with the grain size of 1 μm or less is 50%, and the average grain size of the crystal grains 15 forming the metal texture of the external layer 12 is 2 μm or less. As a result, there is a little difference between the grain sizes of the metal textures forming the internal layer 11 and the external layer 12.

In the composite conductor 10 according to the first embodiment of the present invention, the external layer 12 is formed by the copper-based alloy which is the copper with the silver added, and the average grain size of the crystal grains 15 is 2 μm or less. Thus, the tensile strength of the external layer 12 is 250 MPa or more. Accordingly, a microcrack is prevented from being generated on the external layer 12 even when the composite strand (external layer) is affected by sudden impact force acting under a condition where the composite strand is subjected to cyclic loading. If a fatigue crack is generated on the external layer 12, since the crystal grains 15 forming the external layer 12 has the average grain size of 2 μm or less and the number of the crystal grains 15 per unit volume in the external layer becomes large, the fatigue crack propagating in the external layer 12 frequently clashes with the crystal grains 15. Accordingly, when the fatigue crack propagates, the deflection and the bifurcation of the growing fatigue crack are enhanced, a rate at which the fatigue crack grows in one direction is decreased, and time required for the fatigue crack to penetrate the external layer 12 becomes long. In other words, the external layer 12 has strong bending durability to the cyclic loading (the external layer 12 sustains a large number of bending stress cycles until being fractured).

If the fatigue crack penetrates the external layer 12 and reaches to a surface of the internal layer 11, since the external layer 12 and the internal layer 11 are integrated, the fatigue crack grows into the internal layer 11. The average grain size of the crystal grains 13 forming the internal layer 11 is 2 μm or less and the number of the crystal grains 13 per unit volume in the internal layer 11 becomes large, thus the fatigue crack propagating in the internal layer 11 frequently clashes with the crystal grains 13. Accordingly, when the fatigue crack propagates, the deflection and the bifurcation of the growing fatigue crack are enhanced, the rate at which the fatigue crack grows in one direction is decreased, and the fatigue crack hardly grows in the internal layer 11. Thus, the fatigue test in which the cyclic stress is applied to the internal layer 11 shows that the fatigue strength of the internal layer 11 subjected to $10^6$ cycles of the cyclic loading is 150 MPa or more. If the metal texture of the internal layer 11 includes 20% or more of the crystal grains 13 by cross sectional area with the grain size of 1 μm or less, the number of the crystal grains 13 per unit volume in the internal layer 11 is further increased, the fatigue crack more frequently clashes with and the crystal grains 13, and the deflection and the bifurcation of the fatigue crack are enhanced. Accordingly, the fatigue crack more hardly grows into the internal layer 11.

The electric wire using the composite strands (with the diameter of 0.05 mm or more but not exceeding 0.5 mm) formed by the composite conductor 10 according to the first embodiment of the present invention is used for wiring under an unstable condition, for example, wiring of a drive member for a robot. The composite strand includes (i) the internal layer 11 containing the crystal grains 13 of the aluminium with the average grain size of 2 μm or less and (ii) the external layer 12 placed on the external side of the internal layer 11, containing the crystal grains 15 of the copper-based alloy with the average grain size of 2 μm or less, and having the tensile strength of 250 MPa or more. In this case, the electric wire can be light and highly flexible since the internal layer 11 is formed by the aluminium. Even when the composite strands are affected by the sudden impact force, the microcrack can be prevented from being generated in the external layer 12, the microcrack can be prevented from growing into the fatigue crack in the external layer 12, and the grown fatigue crack can be prevented from growing in the external layer 12. Even when the microcrack penetrating the external layer 12 reaches to the internal layer 11, the microcrack can be prevented from growing in the internal layer 11. Thus, a sudden breaking of the electric wire can be avoided, the robot can be stably operated for a long period (e.g., a design operating time estimated from fatigue life data of the electric wire), and the reliability of the robot can be improved and a burden of maintenance can be reduced.

Figure 2:
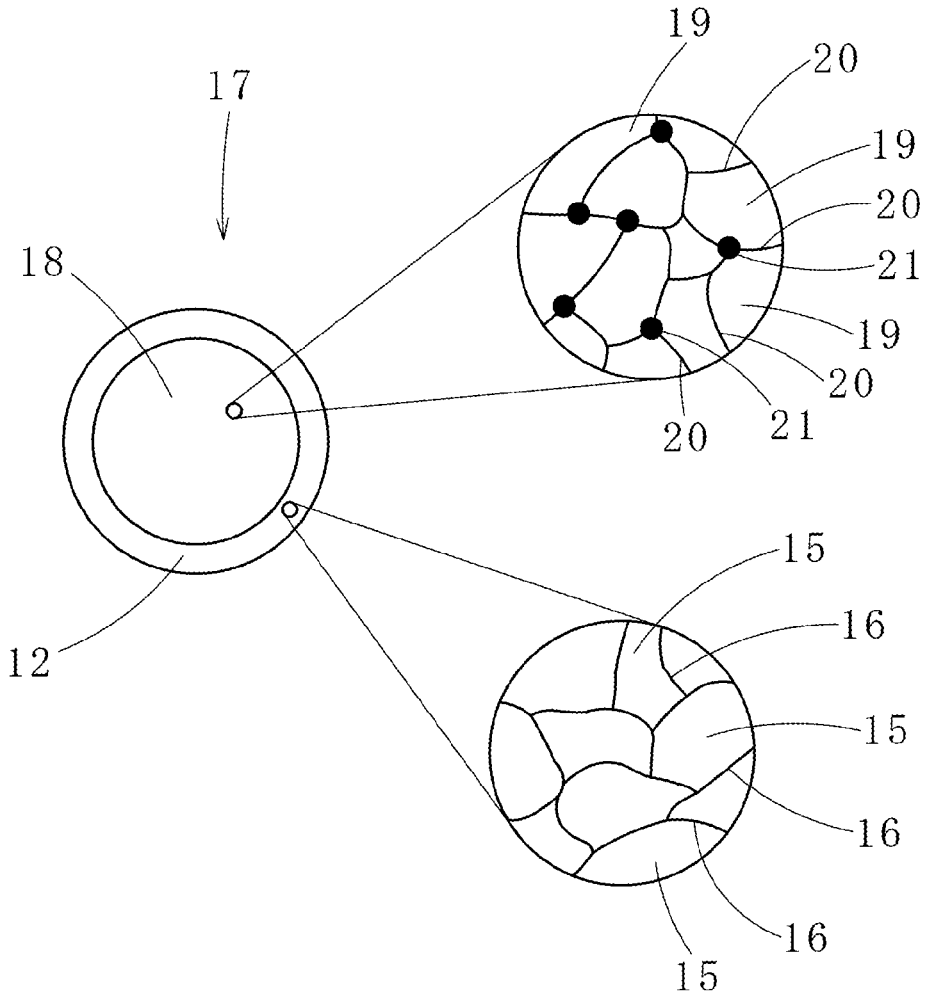
FIG. 2 is an explanatory diagram showing a texture of a composite conductor according to a second embodiment of the present invention.

As shown in FIG. 2, a composite conductor 17 according to a second embodiment of the present invention includes an internal layer 18 coated with the external layer 12 made of the copper silver alloy. The internal layer 18 includes a metal texture, containing (i) aluminium crystal grains 19 formed by aluminium and inevitable impurities (e.g., a contained amount of the inevitable impurities is 0.1 to 0.35 mass %) with an average grain size of 2 μm or less and (ii) nanoscale aluminium-scandium precipitates ($Al_3Sc$ precipitate particles) 21, which is an example of nanoparticles C existing in a grain boundary 20 of the crystal grains 19. A part of the inevitable impurities is dissolved in the crystal grains 19 and the rest thereof exists in the grain boundary 20.

When the average grain size of the crystal grains 19 is controlled to be 2 μm, as observed through a microscopic observation of the metal texture, a maximum grain size of the crystal grains 19 in the metal texture is 4 μm and the fatigue strength of the metal texture subjected to $10^6$ cycles of the cyclic loading in the fatigue test is 300 MPa. When the crystal grains 19 with a grain size of 1 μm or less constitute 20% of the cross sectional area of the metal texture, the average grain size of the crystal grains 19 is 1.5 μm and the fatigue strength of the metal texture subjected to $10^6$ cycles of the cyclic loading in the fatigue test is 330 MPa. When the crystal grains 13 with the grain size of 1 μm or less constitute 50% of the cross sectional area of the metal texture, the average grain size of the crystal grains 19 is 1.2 μm and the fatigue strength of the metal texture subjected to $10^6$ cycles of the cyclic loading in the fatigue test is 350 MPa.

Hereinafter, a description will be given on a method of manufacturing the composite conductor 17.

Aluminium with a purity of 99.9 mass % or more and scandium with a purity of 99 mass % or more are cast into the aluminium including 0.27 to 0.32 mass % of scandium to manufacture a block of conductive material for the internal layer. Then, an aging treatment of the block of the conductive material is performed at 250 to 450° C. for 0.5 to 30 hours, for example, at 350° C. for 1 hour. The block of the conductive material is processed into a rod with a diameter of, for example, 10 mm by cutting work. After the rod and the same tape material used in the first embodiment are cleaned by a wash treatment, the tape material is placed on an external side of the rod such that the tape material and the rod are arranged concentrically to make a composite rod that is the rod coated with the tape material. A process of coating the rod with the tape material is performed under a controlled atmosphere to avoid oxidation of a surface of the rod. If needed, after the tape material and the rod are arranged concentrically, butts of the tape material can be continuously welded by gas welding and the like to make the tape material in a cylindrical shape.

By a pressure (e.g., 100 to 1000 MPa) applied to the composite rod (the tape material) from an outer circumference thereof, the rod and the tape material are pressure-welded (integrated) mechanically. The composite rod, i.e., the integration of rod and tape material, is rolled and processed into a wire with an external diameter of, for example, 1.5 to 2 mm. The wire is heat-treated at 300 to 500° C. for 0.1 to 5 hours, for example, at 350° C. for 1 hour. The heat-treatment enhances formation of isometric crystals, thus the average grain size is minified and a probability of formation of a fine crystal grain with a grain size of 1 μm or less is increased. As a result, the composite conductor 17 including (i) the internal layer 18 containing the crystal grains 19 of an aluminium-based alloy with an average grain size of 2 μm or less and the nanoscale precipitates 21 and (ii) the external layer 12 containing the crystal grains 15 of copper-based alloy with an average grain size of 2 μm or less is made. The composite conductor 17 is pulled through wire drawing dies and processed into a composite strand with a diameter of 0.05 mm or more but not exceeding 0.5 mm, and then the composite strands are processed into a stranded wire to manufacture an electric wire.

When the rod and the tape material are integrated, one or both of the rod and the tape material can be heated (e.g., heated to a temperature equivalent to 40 to 70% of a melting point of the rod or the tape material). The application of heat enhances a plastic deformation, thereby accelerating the pressure welding of the rod and the tape material. The composite rod can be heated in a heating furnace, or the heat can be generated in the composite rod by applying an electric current. Further, the internal layer 18 and the external layer 12 forming the composite conductor 17 can be integrated via a fusion layer by inserting a metal fusion material such as an insert material (e.g., an alloy bond made of a brazing filler material, etc.) between the rod and the tape material. The fusion layer between the internal layer 18 and the external layer 12 enhances the integral formation.

The processing rate in which the composite rod is rolled into the wire is set to 3 to 4, the heat treatment (e.g., a heat treatment temperature is equivalent to 30 to 70% of a melting point of the rod) is performed to accelerate the formation of the isometric crystals, and the processing rate in which the wire is pulled through the wire drawing dies and processed into the composite strand is set to, for example, 4 to 6, preferably to 5 to 6. In this case, the average grain size of the crystal grains 19 forming the metal texture of the internal layer 18 is 2 μm, and the average grain size of the crystal grains 15 forming the metal texture of the external layer 12 is 2 μm. Further, the processing rate in which the composite rod is rolled into the wire is set to 3 to 4, and the processing rate of the die drawing process is set to 4 to 7, preferably 6.5 to 7. In this case, the average grain size of the crystal grains 19 forming the metal texture of the internal layer 18 is 1.5 μm, the cross sectional ratio of the crystal grains 19 with the grain size of 1 μm or less is 20%, and the average grain size of the crystal grains 15 forming the metal texture of the external layer 12 is 2 μm or less. Still further, the processing rate in which the composite rod is rolled into the wire is set to 3 to 4, and the processing rate of the die drawing process is set to 5 to 8, preferably more than 7 but 8 or less. In this case, the average grain size of the crystal grains 19 forming the metal texture of the internal layer 18 is 1.2 μm, the cross sectional ratio of the crystal grains 19 with the grain size of 1 μm or less is 50%, and the average grain size of the crystal grains 15 forming the metal texture of the external layer 12 is 2 μm or less.

The composite conductor 17 according to the second embodiment of the present invention and the composite conductor 10 according to the first embodiment of the present invention have the same functions and effects as a consequence of the following features: (i) the average grain size of the crystal grains 15 forming the external layer 12 is 2 μm or less and the tensile strength of the external layer 12 is 250 MPa or more; and (ii) the average grain size of the crystal grains 19 forming the internal layer 18 is 2 μm or less and the ratio of the crystal grains 19 with the diameter of 1 μm or less is controlled (to be 20% or more by cross sectional area). Thus, a description therefor will be omitted. Hereinafter, an explanation will be given on functions and effects of the composite conductor 17 according to the second embodiment of the present invention as a consequence of the particular feature in which the composite conductor 17 contains 0.1 to 1 mass % of the nanoscale aluminium-scandium precipitates 21.

During the aging treatment of the block of the conductive material, the scandium existing in the crystal grains 19 of aluminium and the grain boundary 20 reacts with the aluminium to be precipitated as the nanoscale (nano-sized) $Al_3Sc$ precipitates 21 in the grain boundary 20. An examination of the nanoscale precipitates 21 existing in the metal texture shows that almost all the added scandium reacts with the aluminium to produce the $Al_3Sc$ precipitate particles. The average grain size of the nanoscale precipitates 21 can be adjusted to, for example, a range of 5 to 50 nm by optimizing the temperature and duration within a range of temperature and duration of the aging treatment. The formation of the nanoscale precipitates 21 suppresses grain growth of the crystal grains 19 of the metal texture forming the internal layer 18, thus the average grain size of the crystal grains 19 can be easily controlled to be 2 μm or less.

When the nanoscale (nano-sized) precipitate 21 is formed in the grain boundary 20 of the crystal grains 19, a tip of the fatigue crack growing along the grain boundary 20 clashes with the nanoscale precipitate 21, the tip of the fatigue crack is pinned by the nanoscale precipitate 21, and the growth of the fatigue crack is stopped. Thus, the growth rate of the fatigue crack is further decreased. When the contained amount of the nanoscale precipitates 21 is less than 0.1 mass %, the amount of the nanoscale precipitates 21 to be produced is decreased and the pinning effect to pin the fatigue crack is reduced. When the contained amount of the nanoscale precipitates 21 exceeds 0.1 mass %, the nanoscale precipitates 21 existing in the grain boundary 20 is increased and the pinning effect to pin the fatigue crack is improved, but the conductivity is decreased and functions as the conductive material is declined. Thus, the contained amount of the nanoscale precipitates 21 is within a range of 0.1 to 1.0 mass %.

The total amount of the nanoscale precipitates 21 to be produced is determined by the contained amount of the scandium. If the number of the nanoscale precipitates 21 is increased, the grain diameter of the nanoscale precipitates 21 is decreased. If the number of the nanoscale precipitates 21 is decreased, the grain diameter of the nanoscale precipitates 21 is increased. The more the number of the nanoscale precipitates 21 and the grain diameter of the nanoscale precipitates 21 are increased, the more the pinning effect of the nanoscale precipitates 21 to pin the fatigue crack growing in the metal texture is increased.

When the average grain size of the nanoscale precipitates 21 is less than 5 nm, the number of the nanoscale precipitates 21 is increased and the fatigue crack is frequently pinned. However, a pinning action of the nanoscale precipitates 21 to pin the fatigue crack is not strong, and the pinning effect to pin the fatigue crack is not remarkable. When the average grain size of the nanoscale precipitates 21 exceeds 50 nm, the pinning action of the nanoscale precipitates 21 to pin the fatigue crack is strong. However, the number of the nanoscale precipitates 21 is decreased and the fatigue crack is less frequently pinned, and the pinning effect to pin the fatigue crack is not remarkable. Thus, when the average grain size of the nanoscale precipitates 21 is 5 to 50 nm under a condition where the total amount of the nanoscale precipitates 21 is constant, the pinning action of the nanoscale precipitates 21 to pin the fatigue crack can be maintained at a high level while the high frequency of pinning the fatigue crack is maintained, and the pinning effect of the nanoscale precipitates 21 to pin the fatigue crack can be improved.

The electric wire using the composite strands (with the diameter of 0.05 mm or more but not exceeding 0.5 mm) formed by the composite conductor 17 according to the second embodiment of the present invention is used for wiring under an unstable condition, for example, wiring of a drive member for a robot. The composite strand includes (i) the internal layer 18 containing the crystal grains 19 of the aluminium with the average grain size of 2 μm or less and the nanoscale $Al_3Sc$ precipitates 21 existing in the grain boundary 20 between the crystal grains 19 and (ii) the external layer 12 placed on the external side of the internal layer 18, containing the crystal grains 15 of the copper silver alloy with the average grain size of 2 μm or less, and having the tensile strength of 250 MPa or more. In this case, the electric wire can be light and highly flexible since the crystal grains 19 forming the internal layer 18 are the aluminium. Even when the composite strands are affected by the sudden impact force, the microcrack can be prevented from being generated in the external layer 12, the microcrack can be prevented from growing into the fatigue crack in the external layer 12, and the grown fatigue crack can be prevented from growing in the external layer 12. Since there is a little difference between the grain sizes of the metal textures forming the internal layer 18 and the external layer 12, even when the microcrack is generated in the external layer 12, the generated microcrack is prevented from being the growing fatigue crack and growing in the internal layer 18 under the cyclic stress loading.

Even when the microcrack penetrating the external layer 12 reaches to the internal layer 18, the deviation of the fatigue crack in the internal layer 18, the crack bifurcation, and the pinning can prevent the fatigue crack from growing in the internal layer 18. Thus, a sudden breaking of the electric wire can be avoided, the robot can be stably operated for, for example, a design operating time estimated from fatigue life data of the electric wire, and the reliability of the robot can be improved and a burden of maintenance can be reduced.

Figure 3:
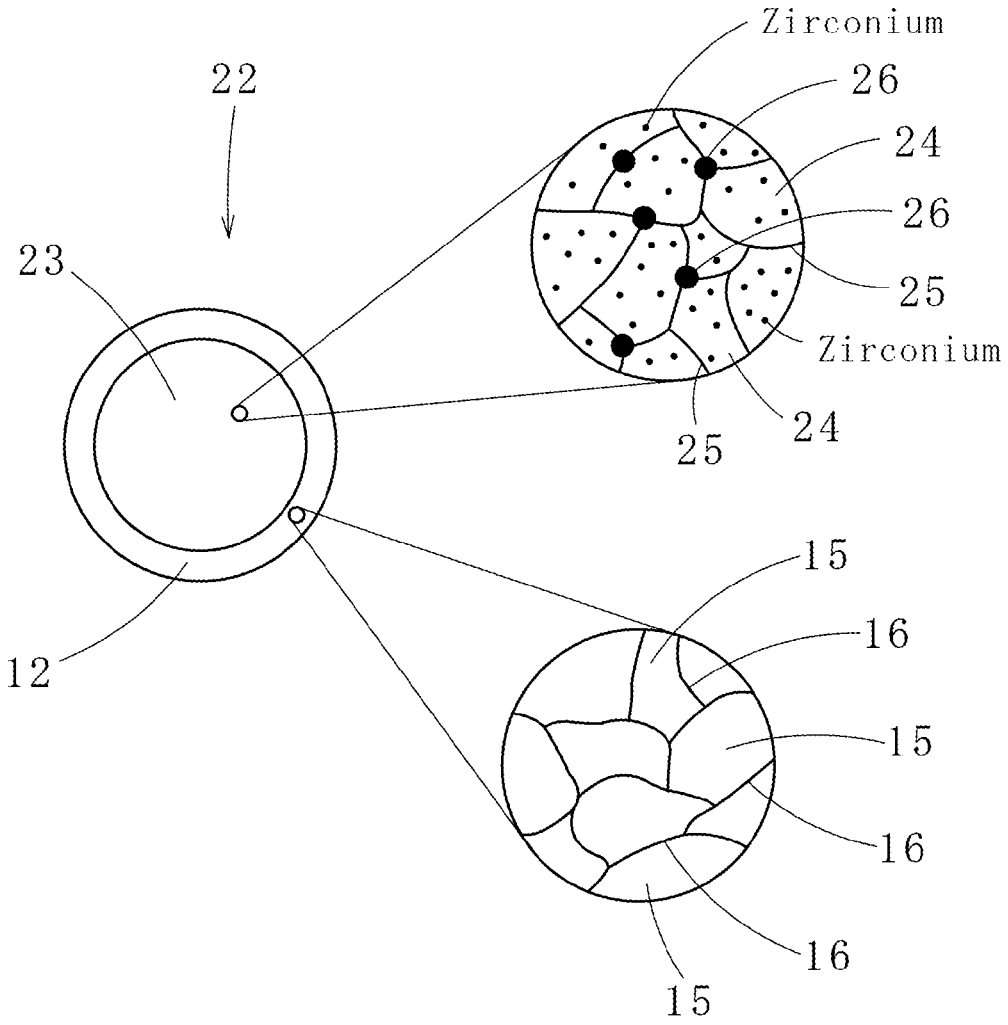
FIG. 3 is an explanatory diagram showing a texture of a composite conductor according to a third embodiment of the present invention.

As shown in FIG. 3, a composite conductor 22 according to a third embodiment of the present invention includes an internal layer 23 coated with the external layer 12 made of the copper silver alloy. The internal layer 23 includes a metal texture containing (i) crystal grains 24 formed by an aluminium-based alloy, which contains 0.1 mass % or more but not exceeding 20 mass % of zirconium and aluminium and inevitable impurities for the rest (e.g., a contained amount of the inevitable impurities is 0.1-0.35 mass %) and has an average grain size of 2 μm or less, and (ii) nanoscale aluminium-scandium precipitates ($Al_3Sc$ precipitate particles) 26, which is an example of nanoparticles C existing in a grain boundary 25 of the crystal grains 24. Zirconium and a part of the inevitable impurities are dissolved in the crystal grains 24 and the rest thereof exists in the grain boundary 25.

When the average grain size of the crystal grains 24 is controlled to be 2 μm, as observed through a microscopic observation of the metal texture, a maximum grain size of the crystal grain 24 in the metal texture is 4 μm and the fatigue strength of the metal texture subjected to $10^6$ cycles of the cyclic loading in the fatigue test is 310 MPa. When the crystal grains 24 with a grain size of 1 μm or less constitute 20% of the cross sectional area of the metal texture, the average grain size of the crystal grains 24 is 1.5 μm and the fatigue strength of the metal texture subjected to $10^6$ cycles of the cyclic loading in the fatigue test is 320 MPa. When the crystal grains 24 with a grain size of 1 μm or less constitute 50% of the cross sectional area of the metal texture, the average grain size of the crystal grains 24 is 1.2 μm and the fatigue strength of the metal texture subjected to $10^6$ cycles of the cyclic loading in the fatigue test is 330 MPa.

Hereinafter, an explanation will be given on a method of manufacturing the composite conductor 22.

Aluminium with a purity of 99.9 mass % or more, scandium with a purity of 99 mass % or more and zirconium with a purity of 99 mass % or more are cast into the aluminium including 0.27 to 0.32 mass % of the scandium and 0.1 mass % or more but not exceeding 0.2 mass % of the zirconium to manufacture a block of conductive material for the internal layer 23. Then, an aging treatment of the block of the conductive material is performed at 250 to 450° C. for 0.5 to 30 hours, for example, at 350° C. for 24 hours. The block of the conductive material is processed into a rod with a diameter of, for example, 10 mm by cutting work. After the rod and the same tape material used in the first embodiment are cleaned by a wash treatment, the tape material is placed on an external side of the rod such that the tape material and the rod are arranged concentrically to make a composite rod that is the rod coated with the tape material. A process of coating the rod with the tape material is performed under a controlled atmosphere to avoid oxidation of a surface of the rod. If needed, after the tape material and the rod are arranged concentrically, butts of the tape material can be continuously welded by gas welding and the like to make the tape material into a cylindrical shape.

During the aging treatment of the block of the conductive material, the scandium existing in the crystal grains 24 and the grain boundary 25 reacts with the aluminium to be precipitated as the nanoscale (nano-sized) $Al_3Sc$ nanoprecipitates 26 in the grain boundary 25. An examination of the nanoscale precipitates 26 in the metal texture shows that almost all the scandium added is reacted with the aluminium to produce the $Al_3Sc$ precipitate particles. The average grain size of the nanoscale precipitates 26 can be adjusted to, for example, a range of 5 to 50 nm by optimizing the temperature and duration within a range of temperature and duration of the aging treatment. The formation of the nanoscale precipitates 26 suppresses grain growth of the crystal grains 24 of the metal texture forming the internal layer 23, thus the average grain size of the crystal grains 24 can be easily controlled to be 2 μm or less. Even after the aging treatment, the zirconium and the inevitable impurities exist in the aluminium grains 24 and the grain boundary 25.

By a pressure (e.g., 100 to 1000 MPa) applied to the composite rod (the tape material) from an outer circumference thereof, the rod and the tape material are pressure-welded (integrated) mechanically. The composite rod, i.e., the integration of rod and tape material, is rolled and processed into a wire with an external diameter of, for example, 1.5 to 2 mm. The wire is heat-treated at 300 to 500° C. for 0.1 to 5 hours, for example, at 450° C. for 1 hour. The heat-treatment enhances formation of isometric crystals, thus the average grain size is minified and a probability of formation of a fine crystal grain with a grain size of 1 μm or less is increased. As a result, the composite conductor 22 including (i) the internal layer 23 containing the crystal grains 24 of the aluminium-based alloy with the average grain size of 2 μm or less and (ii) the external layer 12 composed of crystal grains 15 of copper-based alloy with the average grain size of 2 μm or less is made. The composite conductor 22 is pulled through wire drawing dies and processed into a composite strand with a diameter of 0.05 mm or more but not exceeding 0.5 mm, and then the composite strands are processed into a stranded wire to manufacture an electric wire.

When the rod and the tape material are integrated, one or both of the rod and the tape material can be heated (e.g., heated to a temperature equivalent to 40 to 70% of a melting point of the rod or the tape material). The application of heat enhances a plastic deformation, thereby accelerating the pressure welding of the rod and the tape material. The composite rod can be heated in a heating furnace, or the heat can be generated in the composite rod by applying an electric current. Further, the internal layer 23 and the external layer 12 forming the composite conductor 22 can be integrated via a fusion layer by inserting a metal fusion material such as an insert material (e.g., an alloy bond made of a brazing filler material, etc.) between the rod and the tape material. The fusion layer between the internal layer 23 and the external layer 12 enhances the integral formation.

After the processing rate in which the composite rod is rolled into the wire is set to 3 to 4, the heat treatment (e.g., a heat treatment temperature is equivalent to 30 to 70% of a melting point of the rod) is performed to accelerate the formation of the isometric crystals, and the processing rate in which the wire is pulled through the wire drawing dies and processed into the composite strand is set to, for example, 4 to 6, preferably to 5 to 6. In this case, the average grain size of the crystal grains 24 forming the metal texture of the internal layer 23 is 2 μm, and the average grain size of the crystal grains 15 forming the metal texture of the external layer 12 is 2 μm. Further, the processing rate in which the composite rod is rolled into the wire is set to 3 to 4, and the processing rate of the die drawing process is set to 4 to 7, preferably 6.5 to 7. In this case, the average grain size of the crystal grains 24 forming the metal texture of the internal layer 23 is 1.5 μm, the cross sectional ratio of the crystal grains 24 with the grain size of 1 μm or less is 20%, and the average grain size of the crystal grains 15 forming the metal texture of the external layer 12 is 2 μm or less. Still further, the processing rate in which the composite rod is rolled into the wire is set to 3 to 4, and the processing rate of the die drawing process is set to 5 to 8, preferably more than 7 but 8 or less. In this case, the average grain size of the crystal grains 24 forming the metal texture of the internal layer 23 is 1.2 μm, the cross sectional ratio of the crystal grains 24 with the grain size of 1 μm or less is 50%, and the average grain size of the crystal grains 15 forming the metal texture of the external layer 12 is 2 μm or less.

The composite conductor 22 according to the third embodiment of the present invention and the composite conductor 17 according to the second embodiment of the present invention have the same functions and effects as a consequence of the following features: (i) the average grain size of the crystal grains 15 forming the external layer 12 is 2 μm or less and the tensile strength of the external layer 12 is 250 MPa or more; (ii) the average grain size of the crystal grains 24 forming the internal layer 23 is 2 μm or less and the ratio of the crystal grains 24 with the diameter of 1 μm or less is controlled; and (iii) 0.1 to 1.0 mass % of the scandium is contained and thus the nanoscale $Al_3Sc$ precipitates 26 are formed in the grain boundary 25 of the crystal grains 24. Thus, a description therefor will be omitted. Hereinafter, an explanation will be given on functions and effects of the composite conductor 22 according to the third embodiment of the present invention as a consequence of the particular feature in which the composite conductor 22 includes 0.1 mass % or more but not exceeding 0.2 mass % of the zirconium.

For example, a tensile strength $\sigma_{RT}$ of a wire rod including a metal texture, which contains 0.3 mass % of nanoscale aluminium-scandium precipitates existing in the grain boundary of crystal grains of aluminium, is 300 MPa at room temperature. Shortly after this wire rod is heated for one hour at 260° C., a tensile strength $\sigma_{260}$ of the wire rod is 294 MPa and heat resistance thereof is 98%, assessed by $(\sigma_{260}/\sigma_{RT})\times 100$. A tensile strength $\sigma_{RT}$ of a wire rod including a metal texture, which contains 0.3 mass % of nanoscale aluminium-scandium precipitates existing in the grain boundary of aluminium crystal grains with 0.01 mass % of zirconium dissolved, is 300 MPa at room temperature. Shortly after this wire rod is heated for one hour at 260° C., a tensile strength $\sigma_{260}$ of the wire rod is 294 MPa and heat resistance thereof is 98%. A tensile strength $\sigma_{RT}$ of a wire rod including a metal texture, which contains 0.3 mass % of nanoscale aluminium-scandium precipitates existing in the grain boundary of crystal grains of aluminium with 0.05 mass % of zirconium dissolved is 305 MPa at room temperature. Shortly after this wire rod is heated for one hour at 260° C., a tensile strength $\sigma_{260}$ of the wire rod is 303 MPa and heat resistance thereof is 99%. A tensile strength $\sigma_{RT}$ of a wire rod including a metal texture, which contains 0.3 mass % of nanoscale aluminium-scandium precipitates existing in the grain boundary of crystal grains of aluminium with 0.1 mass % of zirconium dissolved, is 310 MPa at room temperature. Shortly after this wire rod is heated for one hour at 260° C., a tensile strength $\sigma_{260}$ of the wire rod is 309 MPa and heat resistance thereof is 100%.

As described above, when the zirconium exists in the crystal grains 24 and the grain boundary 25 forming the metal texture of the internal layer 23, a textural alteration such as grain growth can be avoided even if the internal layer 23 is affected by thermal history of high temperature, and the decrease in the tensile strength is avoided. When the dissolved amount (contained amount) of zirconium exceeds 0.2 mass %, an effect of improving the tensile strength of the internal layer 23 affected by the thermal history is improved, but the conductivity is decreased and functions as the conductive material are declined. Thus, the contained amount of the zirconium is preferably 0.1 mass % or more but not exceeding 0.2 mass %. When the internal layer 23 of the composite conductor 22 contains 0.1 mass % or more but not exceeding 0.2 mass % of the zirconium, the decrease in the tensile strength of the internal layer 23 can be avoided even if the composite conductor 22 is affected by the thermal history of high temperature, and thus the strength of the composite material 22 can be maintained.

The electric wire using the composite strands (with the diameter of 0.05 mm or more but not exceeding 0.5 mm) formed by the composite conductor 22 according to the third embodiment of the present invention is used for wiring under an unstable condition, for example, wiring of a drive member for a robot. The composite strand includes (i) the internal layer 23 containing the crystal grains 24 of the aluminium with the zirconium dissolved and having the average grain size of 2 μm or less, the grain boundary 25 in which the zirconium is dispersed, and the nanoscale $Al_3Sc$ precipitates 26 existing in the grain boundary 25 and (ii) the external layer 12 placed on the external side of the internal layer 23, containing the crystal grains 15 of the copper silver alloy with the average grain size of 2 μm or less, and having the tensile strength of 250 MPa or more. In this case, the electric wire can be light and highly flexible since the crystal grains 24 forming the internal layer 23 is the aluminium-based alloy. Even when the composite strands are affected by the sudden impact force, the microcrack can be prevented from being generated in the external layer 12, the microcrack can be prevented from growing into the fatigue crack in the external layer 12, and the fatigue crack can be prevented from growing in the external layer 12. Even when the fatigue crack penetrating the external layer 12 reaches to the internal layer 23, the deflection of the fatigue crack in the internal layer 23, the crack bifurcation, and the pinning can prevent the fatigue crack from growing in the internal layer 23. Since a part of the zirconium is dissolved in the crystal grains 24 and the rest thereof exists in the grain boundary 25, the decrease in the tensile strength of the internal layer 23 affected by the thermal history of high temperature can be avoided, and thus the decrease in the tensile strength of the composite conductor 22 affected by the thermal history of high temperature can be avoided.

When the composite conductor 22 according to the third embodiment of the present invention is used for manufacturing an electric wire for wiring of a drive member (an arm) of a robot, which is possibly exposed to a high-temperature environment such as an industrial plant and a disaster site, the tensile strength and the durability of the electric wire temporarily exposed to the high temperature can be ensured, and a sudden breaking of the electric wire can be avoided. Thus, the robot can be stably operated for, for example, a design operating time estimated from fatigue life data of the electric wire, and the reliability of the robot is improved and a burden of maintenance is reduced.

A composite conductor according to a fourth embodiment of the present invention includes an internal layer coated with an external layer. The internal layer includes copper that is an example of conductive materials A having fatigue strength of at least 150 MPa after being subjected to $10^6$ cycles of cyclic loading in a fatigue test. The external layer includes a copper silver alloy that is an example of conductive materials B having tensile strength of at least 250 MPa, which is higher than the tensile strength of the copper.

The internal layer is composed of a metal texture which includes copper crystal grains having an average grain size of 2 μm or less and containing less than 0.1 mass % of inevitable impurities, for example. When an average grain size of the copper crystal grains is controlled to be 2 rpm, as observed through a microscopic observation of the metal texture, a maximum grain size of the copper crystal grains in the metal texture is 4 μm and the fatigue strength of the metal texture subjected to $10^6$ cycles of the cyclic loading in the fatigue test is 250 MPa. When the copper crystal grains with a grain size of 1 μm or less constitutes 20% of the cross sectional area of the metal texture, the average grain size of the copper crystal grains is 1.5 μm and the fatigue strength of the metal texture subjected to $10^6$ cycles of the cyclic loading in the fatigue test is 270 MPa. When the copper crystal grains with a grain size of 1 μm or less constitutes 50% of the cross sectional area of the metal texture, the average grain size of the copper crystal grains is 1.2 μm and the fatigue strength of the metal texture subjected to $10^6$ cycles of the cyclic loading in the fatigue test is 290 MPa.

The external layer is composed of a metal texture which includes crystal grains of copper silver alloy having an average grain size of 2 μm or less and containing 1 mass % or more but not exceeding 10 mass % of silver and copper and also includes inevitable impurities for the rest (a contained amount of the inevitable impurities is, for example, 0.1 to 0.7 mass %). A part of the inevitable impurities is dissolved in the crystal grains of the copper silver alloy and the rest thereof exists in a grain boundary of the crystal grains of the copper silver alloy. When the average grain size of the crystal grains of the copper silver alloy is controlled to be 2 μm or less, as observed through a microscopic observation of the metal texture, a maximum grain size of the crystal grains of the copper silver alloy in the metal texture is 4 μm and the fatigue strength can be controlled to be, for example, 450 MPa. Preferably, a strength ratio $\sigma_B/\sigma_A$ of tensile strength $\sigma_B$ of the conductive material B to tensile strength $\sigma_A$ of the conductive material A is 1.6 or more.

Hereinafter, an explanation will be given on a method of manufacturing the composite conductor according to the fourth embodiment of the present invention. Copper with a purity of 99.9 mass % or more is made into a block of a conductive material for the internal layer. This block of the conductive material is processed into a rod with a diameter of, for example, 10 mm by cutting work. Copper with a purity of 99.9 mass % or more and silver with a purity of 99 mass % or more are cast into a block of conductive material consisting of a copper silver alloy containing 1 to 10% silver for the external layer, and the block of the conductive material is processed into a tape material with a thickness of, for example, 1 mm. After the rod and the tape material are cleaned by wash treatment, the tape material is placed on an external side of the rod such that the tape material and the rod are arranged concentrically to make a composite rod that is the rod coated with the tape material. A process of coating the rod with the tape material is performed under a controlled atmosphere to avoid oxidation of a surface of the rod. If needed, after the tape material and the rod are arranged concentrically, butts of the tape material can be continuously welded by gas welding and the like to make the tape material into a cylindrical shape.

By a pressure (e.g., 100 to 1000 MPa) applied to the composite rod (the tape material) from an outer circumference thereof, the rod and the tape material are pressure-welded (integrated) mechanically. The composite rod, i.e., the integration of rod and tape material, is rolled and processed into a wire with an external diameter of, for example, 1.5 to 2 mm. The wire is heat-treated at 400 to 650° C. for 0.1 to 5 hours, for example, at 500° C. for 5 hours. The heat-treatment enhances formation of isometric crystals, thus the average grain size is minified and a probability of formation of a fine crystal grain with a grain size of 1 μm or less is increased. As a result, the composite conductor including (i) the internal layer containing copper crystal grains with an average grain size of 2 μm or less and (ii) the external layer containing crystal grains of the copper silver alloy with an average grain size of 2 μm or less is made. The die drawing process is performed on a composite conductor to form a composite strand with a diameter of 0.05 mm or more but not exceeding 0.5 mm, and then the composite strands are processed into a stranded wire to manufacture an electric wire.

When the rod and the tape material are integrated, one or both of the rod and the tape material can be heated (e.g., heated to a temperature equivalent to 40 to 70% of a melting point of the rod or the tape material). The application of heat enhances a plastic deformation, thereby accelerating the pressure welding of the rod and the tape material. The composite rod can be heated in a heating furnace, or the heat can be generated in the composite rod by applying an electric current. Further, the internal layer and the external layer forming a compound conductor can be integrated via a fusion layer by inserting a metal fusion material such as an insert material (e.g., an alloy bond made of a brazing filler material, etc.) between the rod and the tape material. The fusion layer between the internal layer and the external layer enhances the integral formation.

The processing rate in which the composite rod is rolled into the wire is set to 3 to 4, and the processing rate of the die drawing process is set to 4 to 6, preferably to 5 to 6. In this case, the average grain size of the copper crystal grains forming the metal texture of the internal layer is 2 μm, and the average grain size of the crystal grains of copper silver alloy forming the metal texture of the external layer is 2 μm. Further, the processing rate in which the composite rod is rolled into the wire is set to 3 to 4, and the processing rate of the die drawing process is set to 4 to 7, preferably 6.5 to 7. In this case, the average grain size of the copper crystal grains forming the metal texture of the internal layer is 1.5 μm, the cross sectional ratio of the copper crystal grains with the grain size of 1 μm or less is 20%, and the average grain size of the crystal grains of copper silver alloy forming the metal texture of the external layer is 2 μm or less. Still further, the processing rate in which the composite rod is rolled into the wire is set to 3 to 4, and the processing rate of the die drawing process is set to 5 to 8, preferably more than 7 but 8 or less. In this case, the average grain size of the copper crystal grains forming the metal texture of the internal layer is 1.2 μm, the cross sectional ratio of the copper crystal grains with the grain size of 1 μm or less is 50%, and the average grain size of the crystal grains of copper silver alloy forming the metal texture of the external layer is 2 μm or less.

In the composite conductor according to the fourth embodiment of the present invention, the external layer is formed by the copper silver alloy and the average grain size of the crystal grains of the copper silver alloy is 2 μm or less. Thus, the tensile strength of the external layer is 250 MPa or more. Thus, a microcrack is prevented from being generated on the external layer even when the composite strand (external layer) is affected by sudden impact force acting under a condition where the composite strand is subjected to cyclic loading. Also, the microcrack generated in the external layer is prevented from growing into a progressive fatigue crack under a condition where the composite strand is subjected to cyclic loading. If a fatigue crack is generated on the external layer, since the crystal grains of the copper silver alloy forming the external layer has the average grain size of 2 μm or less, the number of the crystal grains of the copper silver alloy per unit volume in the external layer becomes large, and the fatigue crack propagating in the external layer frequently clashes with the crystal grains of the copper silver alloy. Accordingly, the deflection and the bifurcation of the growing fatigue crack are enhanced, a rate at which the fatigue crack grows in one direction is decreased, and time required for the fatigue crack to penetrate the external layer becomes long.

If the fatigue crack penetrates the external layer and reaches to a surface of the internal layer, since the external layer and the internal layer are integrated, the fatigue crack grows in the internal layer. Since the average grain size of the copper crystal grains forming the internal layer is 2 μm or less and the number of the copper crystal grains per unit volume in the internal layer becomes large, thus the fatigue crack propagating in the internal layer frequently clashes with the copper grains. Accordingly, the deflection and the bifurcation of the growing fatigue crack are enhanced, the rate at which the fatigue crack grows in one direction is decreased, and the fatigue crack hardly grows in the internal layer. Thus, the fatigue test in which the cyclic stress is applied to the internal layer shows that the fatigue strength of the internal layer subjected to $10^6$ cycles of the cyclic loading is 150 MPa or more. If the metal texture of the internal layer includes 20% or more of the copper crystal grains by cross sectional area with the grain size of 1 μm or less, the number of the crystal grains per unit volume in the internal layer is further increased, the fatigue crack more frequently clashes with the copper crystal grains, and the deflection and the bifurcation of the fatigue crack are enhanced. Accordingly, the fatigue crack more hardly grows in the internal layer.

The electric wire using the composite strands (with the diameter of 0.05 mm or more but not exceeding 0.5 mm) formed by the composite conductor according to the fourth embodiment of the present invention is used for wiring under an unstable condition, for example, wiring of a drive member for a robot. The composite strand includes (i) the internal layer containing the copper crystal grains with the average grain size of 2 μm or less and (ii) the external layer placed on the external side of the internal layer, containing the crystal grains of the copper silver alloy with the average grain size of 2 μm or less, and having the tensile strength of 250 MPa or more. In this case, even when the composite strands are affected by the sudden impact force, the microcrack can be prevented from being generated in the external layer, the microcrack can be prevented from growing into the fatigue crack in the external layer, and the grown fatigue crack can be prevented from growing in the external layer. Even when the microcrack penetrating the external layer reaches to the internal layer, the microcrack can be prevented from growing in the internal layer. Thus, a sudden breaking of the electric wire can be avoided, the robot can be stably operated for a long period (e.g., a design operating time estimated from fatigue life data of the electric wire), and the reliability of the robot can be improved and a burden of maintenance can be reduced.

A composite conductor according to a fifth embodiment of the present invention includes an internal layer (conductive material A) coated with an external layer composed of a silver-based alloy (conductive material B). The internal layer includes a metal texture, containing (i) aluminium crystal grains which include aluminium and inevitable impurities (e.g., a contained amount of the inevitable impurities is 0.1-0.35 mass %) and has an average grain size of 2 μm or less, and (ii) nanoscale aluminium-scandium precipitates ($Al_3Sc$ precipitate particles) which is an example of 0.1 mass % or more but not exceeding 1 mass % of nanoparticles C existing in a grain boundary of the aluminium crystal grains. A part of the inevitable impurities is dissolved in the aluminium crystal grains and the rest thereof exists in the grain boundary.

When an average grain size of the aluminium crystal grains is controlled to be 2 μm or less, as observed through a microscopic observation of the metal texture, a maximum grain size of the aluminium crystal grain in the metal texture is 4 μm and the fatigue strength of the metal texture subjected to $10^6$ cycles of the cyclic loading in the fatigue test is 150 MPa. When the aluminium crystal grains with a grain size of 1 μm or less constitute 20% of the cross sectional area of the metal texture, the average grain size of the aluminium crystal grains is 1.5 μm and the fatigue strength of the metal texture subjected to $10^6$ cycles of the cyclic loading in the fatigue test is 200 MPa. When the aluminium crystal grains with the grain size of 1 μm or less constitute 50% of the cross sectional area of the metal texture, the average grain size of the aluminium crystal grains is 1.2 μm and the fatigue strength of the metal texture subjected to $10^6$ cycles of the cyclic loading in the fatigue test is 220 MPa.

The silver-based alloy includes a metal texture, containing crystal grains of a silver alloy with an average grain size of 2 μm or less, in which the silver alloy includes 1 mass % or more but not exceeding 13 mass % of zinc, 1 mass % or more but not exceeding 13 mass % of tin, and 1 mass % or more but not exceeding 10 mass % of indium, and silver and inevitable impurities (e.g., 0.1-3 mass % of calcium) for the rest. A part of the inevitable impurities is dissolved in the crystal grains of the silver alloy and the rest thereof exists in the grain boundary. When the average grain size of the crystal grains of the silver alloy is controlled to be 2 μm, as observed through a microscopic observation of the metal texture, a maximum grain size of the crystal grains of the silver alloy in the metal texture is 4 μm and the tensile strength of the metal texture is 270 MPa.

Hereinafter, an explanation will be given on a method of manufacturing the composite conductor according to the fifth embodiment of the present invention. Aluminium with a purity of 99.9 mass % or more and scandium with a purity of 99 mass % or more are cast into the aluminium containing 0.27 to 0.32 mass % of the scandium to manufacture a block of conductive material for the internal layer. Then, an aging treatment of the block of the conductive material is performed at 250 to 450° C. for 0.5 to 30 hours, for example, at 350° C. for 1 hour. The block of the conductive material is processed into a rod with a diameter of, for example, 10 mm by cutting work.

Silver with a purity of 99 mass % or more and zinc, tin, and indium with each purity being 99 mass % or more are cast into a silver-based alloy including 1 to 13 mass % of zinc, 1 to 13 mass % of tin, and 1 to 10 mass % of indium to manufacture a block of conductive material for the external layer. The block of the conductive material is processed into a tape material with a thickness of, for example, 1 mm. After the rod and the tape material are cleaned by a wash treatment, the tape material is placed on an external side of the rod such that the tape material and the rod are arranged concentrically to make a composite rod that is the rod coated with the tape material. A process of coating the rod with the tape material is performed under a controlled atmosphere to avoid oxidation of a surface of the rod. If needed, after the tape material and the rod are arranged concentrically, butts of the tape material can be continuously welded by gas welding and the like to make the tape material into a cylindrical shape.

By a pressure (e.g., 100 to 1000 MPa) applied to the composite rod (the tape material) from an outer circumference thereof, the rod and the tape material are pressure-welded (integrated) mechanically. The composite rod, i.e., the integration of rod and tape material, is rolled and processed into a wire with an external diameter of, for example, 1 to 2 mm. The wire is heat-treated at 300 to 500° C. for 0.1 to 5 hours, for example, at 350° C. for 1 hour. The heat-treatment enhances formation of isometric crystals, thus the average grain size is minified and a probability of formation of a fine crystal grain with a grain size of 1 μm or less is increased. As a result, the composite conductor including (i) the internal layer containing the crystal grains of the aluminium and the nanoscale aluminium-scandium precipitates with an average grain size of 2 μm or less and (ii) the external layer containing the crystal grains of the silver-based alloy with an average grain size of 2 μm or less is made. The die drawing process is performed on the composite conductor to form a composite strand with a diameter of 0.05 mm or more but not exceeding 0.5 mm, and then the composite strands are processed into a stranded wire to manufacture an electric wire.

When the rod and the tape material are integrated, one or both of the rod and the tape material can be heated (e.g., heated to a temperature equivalent to 40 to 70% of a melting point of the rod or the tape material). The application of heat enhances a plastic deformation, thereby accelerating the pressure welding of the rod and the tape material. The composite rod can be heated in a heating furnace, or the heat can be generated in the composite rod by applying an electric current. Further, the internal layer and the external layer forming the composite conductor can be integrated via a fusion layer by inserting a metal fusion material such as an insert material (e.g., an alloy bond made of a brazing filler material, etc.) between the rod and the tape material. The fusion layer between the internal layer and the external layer enhances the integral formation.

After the processing rate in which the composite rod is rolled into the wire is set to 3 to 4, heat treatment is performed, and the processing rate in which the composite strand is formed through the wire drawing die is set to 4 to 6, preferably to 5 to 6. In this case, the average grain size of the crystal grains forming the metal texture of the internal layer is 2 μm, and the average grain size of the crystal grains of the silver-based alloy forming the metal texture of the external layer is 2 μm. Further, the processing rate in which the composite rod is rolled into the wire is set to 3 to 4, and the processing rate of the die drawing process is set to 4 to 7, preferably 6.5 to 7. In this case, the average grain size of the crystal grains forming the metal texture of the internal layer is 1.5 μm, the cross sectional ratio of the crystal grains with the grain size of 1 μm or less is 20%, and the average grain size of the crystal grains of the silver-based alloy forming the metal texture of the external layer is 2 μm or less. Still further, the processing rate in which the composite rod is rolled into the wire is set to 3 to 4, and the processing rate of the die drawing process is set to 5 to 8, preferably more than 7 but 8 or less. In this case, the average grain size of the crystal grains forming the metal texture of the internal layer is 1.2 μm, the cross sectional ratio of the crystal grains with the grain size of 1 μm or less is 50%, and the average grain size of the crystal grains of the silver-based alloy forming the metal texture of the external layer is 2 μm or less.

In the composite conductor according to the fifth embodiment of the present invention, since the external layer is formed by the silver-based alloy and the average grain size of the crystal grains of the silver-based alloy is 2 μm or less, the tensile strength of the external layer is 150 MPa or more and the number of layers of the crystal grains of silver-based alloy forming the external layer becomes 2 or more. Thus, the fatigue crack is prevented from penetrating the external layer.

If the fatigue crack penetrates the external layer and reaches to a surface of the internal layer, since the external layer and the internal layer are integrated, the fatigue crack grows within the internal layer. The average grain size of the crystal grains forming the internal layer is 2 μm or less and the number of the crystal grains per unit volume in the internal layer becomes large, thus the fatigue crack propagating in the internal layer frequently clashes with the crystal grains. Accordingly, the deflection and the bifurcation of the growing fatigue crack are enhanced, the rate at which the fatigue crack grows in one direction is decreased, and the fatigue crack hardly grows into the internal layer. Thus, the fatigue test in which the cyclic stress is applied to the internal layer shows that the fatigue strength of the internal layer subjected to $10^6$ cycles of the cyclic loading is 150 MPa or more. If the metal texture of the internal layer includes 20% or more of the crystal grains by cross sectional area with the grain size of 1 μm or less, the number of the crystal grains per unit volume in the internal layer is further increased, the fatigue crack more frequently clashes with the crystal grains, and the deflection and the bifurcation of the fatigue crack are enhanced. Accordingly, the fatigue crack more hardly grows in the internal layer.

In an electric wire using composite strands formed by the composite conductor according to the fifth embodiment of the present invention, since the internal layer is formed by the aluminium crystal grains, the weight of the composite conductor can be light. For example, when the composite conductor is used for wiring of transporting machines such as an automobile and an aircraft, the weight of the transporting machines can be reduced.

Since the wiring of the transporting machines is the wiring under an unstable condition where low-frequency oscillation constantly acts, the electric wire is subjected to cyclic bending stress. However, since the wire diameter of the composite strand is 0.05 mm or more but not exceeding 0.5 mm, a strain that is generated in the composite strand when the cyclic bending stress is applied to the electric wire can be minified. The external layer includes the crystal grains of the silver-based alloy with the average grain size of 2 μm or less and having the tensile strength of 150 MPa or more that is higher than the tensile strength of the internal layer, thus the generation and the growth of the crack in the external layer is avoided under the condition where the composite strands are affected by the cyclic bending stress. The internal layer includes the aluminium crystal grains with the average grain size of 2 μm or less and the nanoscale precipitates ($Al_3Sc$ precipitate particles). Accordingly, even when the generated crack penetrates the external layer, reaches to the internal layer, and grows in the internal layer, the deflection and the bifurcation of the crack are enhanced and the growth rate of the crack is decreased. Thus, the early breaking of the wiring of the transporting machine can be avoided to improve the reliability of the transporting machine and to reduce a burden of maintenance.

Since the external layer of the composite conductor is formed by the silver-based alloy, the electric wire using the composite strands formed by the composite conductor can improve subsidiary characteristics such as conductivity with terminals and solderability. Thus, the reliability and the efficiency of the wiring operation are improved. Also, an improvement of transmission characteristics of high-frequency signals associated with skin effect can be achieved with a comparatively little amount of silver used.

Hereinafter, an explanation will be given on experimental examples and comparative examples to check functions and effects of the present invention.

Experimental Examples 1 to 6

A composite strand 1 with a diameter of 80 μm was manufactured, including (i) an internal layer composed of a metal texture containing aluminium crystal grains with an average grain size of 2 μm and 0.1 mass % nanoscale aluminium-scandium precipitates existing in a grain boundary of the aluminium crystal grains and (ii) an external layer (10 μm thick) composed of a metal texture containing crystal grains of a copper silver alloy (including 5 mass % silver, the same applies hereinafter) with an average grain size of 2 μm. A composite strand 2 with a diameter of 80 μm was manufactured, including (i) an internal layer composed of a metal texture containing aluminium crystal grains with an average grain size of 2 μm and 0.5 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2 μm. A composite strand 3 with a diameter of 80 μm was manufactured, including (i) an internal layer composed of a metal texture containing aluminium crystal grains with an average grain size of 2 μm and 1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2 μm. Stranded wires were formed by using the composite strands 1 to 3, and electric wires 1 to 3, each with a cross sectional area of 0.2 $mm^2$, were manufactured by using the stranded wires.

A composite strand 4 with a diameter of 80 μm was manufactured, including (i) an internal layer composed of a metal texture containing aluminium crystal grains with an average grain size of 1.5 μm (crystal grains with a grain size of 1 μm or less exist 20% by cross sectional area) and 0.1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2 μm. A composite strand 5 with a diameter of 80 μm was manufactured, including (i) an internal layer composed of a metal texture containing aluminium crystal grains with an average grain size of 1.5 μm (crystal grains with a grain size of 1 μm or less exist 20% by cross sectional area) and 0.5 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2 μm. A composite strand 6 with a diameter of 80 μm was manufactured, including (i) an internal layer composed of a metal texture containing aluminium crystal grains with an average grain size of 1.5 μm (crystal grains with a grain size of 1 μm or less exist 20% by cross sectional area) and 1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2 μm. Stranded wires were formed by using the composite strands 4 to 6, and electric wires 4 to 6 each with a cross sectional area of 0.2 $mm^2$ were manufactured by using the stranded wires.

An impact force added bending test was conducted to obtain the number of cycles to fracture (hereinafter referred to as the number of cycles to fracture under impact force). In the test, a simulated situation where the electric wire (composite strands) was affected by a sudden impact force was created under a condition where the electric wire was subjected to a cyclic stress. The cyclic stress was caused by clamping a part to which a bending stress from side to side was applied with a clip and applying a 50-N clamping force to the part, when the bending stress from side to side with a bending radius of 15 mm and a bending angle range of ±90 degrees was applied to each of the electric wires 1 to 6 with a 100-g load loaded at room temperature. Here, applying the 50-N clamping force to each of the electric wires 1 to 6 corresponds to applying, for example, approximately 200 to 500% of the impact force of the cyclic stress loaded on each of the electric wires 1 to 6. Using the manufactured electric wires 1 to 6, conductivities thereof were obtained. Table 1 shows the number of cycles to fracture under impact force and the conductivity obtained.

TABLE 1

| | Internal Layer | | External Layer | Number of Cycles | | | |
|---|---|---|---|---|---|---|---|
| Experimental Example | Average Grain Size of Crystal Grains (μm) | Nanoscale Precipitates (mass %) | Average Grain Size of Crystal Grains (μm) | to Fracture under Impact Force (million cycles) | Conductivity (% IACS) | Fatigue Strength (MPa) | Tensile Strength of External Layer (MPa) |
| 1 | 2 | 0.1 | 2 | 3.5 | 64 | 156 | 450 |
| 2 | 2 | 0.5 | 2 | 4.6 | 62 | 182 | 450 |
| 3 | 2 | 1 | 2 | 3.8 | 56 | 155 | 450 |
| 4 | 1.5 | 0.1 | 2 | 3.9 | 63 | 165 | 450 |
| 5 | 1.5 | 0.5 | 2 | 6.15 | 61 | 209 | 450 |
| 6 | 1.5 | 1 | 2 | 4.0 | 55 | 171 | 450 |

Members having almost the same sectional structure as the composite strands 1 to 6 on average were manufactured. Each of the members had a length of 30 mm, a width of 3 mm, and a thickness of 0.3 mm, and included a hole with a diameter of 0.5 mm formed in a central part of a width direction of a region positioned 24 mm away from one end of the member in a longitudinal direction. Surfaces of the members with the holes formed were mirror-finished to manufacture test specimens 1 to 6. Each of the test specimens 1 to 6 included a holder attached in the other end such that a tip of the holder was positioned 1 mm away from a center of the hole. The holder was fixed to a voice coil part of an acoustic speaker with one end of each test specimen 1 to 6 facing downward. The fatigue test was conducted by vibrating the voice coil to make each of the test specimens 1 to 6 under a primary resonance condition. A maximum stress generated in a base of the holder attached to each of the test specimens 1 to 6 was calculated by the cantilever beam bending formula, which was used as stress amplitude in the fatigue test. A stress at fracture after $10^6$ cycles of cyclic loading was calculated, which was used as the fatigue strength of the internal layer. Tensile specimens 1 to 6 having almost the same sectional structure as the external layers of the composite strands 1 to 6 on average were manufactured to obtain tensile strengths, in which each of the tensile specimens 1 to 6 had a length of 31 mm, a width of 8.5 mm, and a thickness of 1 mm. Table 1 shows the fatigue strength and the tensile strength obtained.

Comparative Examples R1 to R9

A composite strand R1 with a diameter of 80 μm was manufactured, including (i) an internal layer composed of a metal texture containing aluminium crystal grains with an average grain size of 2 μm and 0.05 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2 μm. A composite strand R2 with a diameter of 80 μm was manufactured, including (i) an internal layer composed of a metal texture containing aluminium crystal grains with an average grain size of 2 μm and 1.1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2 μm. A composite strand R3 with a diameter of 80 μm was manufactured, including (i) an internal layer composed of a metal texture containing aluminium grains crystal with an average grain size of 1.5 μm and 0.05 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2 μm. A composite strand R4 with a diameter of 80 μm was manufactured, including (i) an internal layer composed of a metal texture containing aluminium crystal grains with an average grain size of 1.5 μm and 1.1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2 μm. Stranded wires were formed by using the composite strands R1 to R4, and electric wires R1 to R4, each with a cross sectional area of 0.2 $mm^2$, were manufactured by using the stranded wires.

A composite strand R5 with a diameter of 80 μm was manufactured, including (i) an internal layer composed of a metal texture containing aluminium crystal grains with an average grain size of 2.5 μm and 0.05 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2 μm. A composite strand R6 with a diameter of 80 μm was manufactured, including (i) an internal layer composed of a metal texture containing aluminium crystal grains with an average grain size of 2.5 μm and 0.1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2 μm. A composite strand R7 with a diameter of 80 μm was manufactured, including (i) an internal layer composed of a metal texture containing aluminium crystal grains with an average grain size of 2.5 μm and 0.5 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2 μm. A composite strand R8 with a diameter of 80 μm was manufactured, including (i) an internal layer composed of a metal texture containing aluminium crystal grains with an average grain size of 2.5 μm and 1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2 μm. A composite strand R9 with a diameter of 80 μm was manufactured, including (i) an internal layer composed of a metal texture containing aluminium crystal grains with an average grain size of 2.5 μm and 1.1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2 μm. Stranded wires were formed by using the composite strands R5 to R9, and electric wires R5 to R9, each with a cross sectional area of 0.2 $mm^2$, were manufactured by using the stranded wires.

The same impact force added bending test as in the experimental examples 1 to 6 was conducted on each of the electric wires R1 to R9 at room temperature to obtain the number of cycles to fracture under impact force. Using the manufactured electric wires R1 to R9, conductivities thereof were obtained. Table 2 shows the number of cycles to fracture under impact force and the conductivity obtained. Like the experimental examples 1 to 6, test specimens R1 to R9 having almost the same sectional structure as the composite strands R1 to R9 on average were manufactured to conduct the fatigue tests. A stress at fracture after $10^6$ cycles of cyclic loading was calculated, which was used as the fatigue strength of the internal layer. Tensile specimens R1 to R9 similar to the ones in the experimental examples 1 to 6 were manufactured to obtain tensile strengths. Table 2 shows the fatigue strength and the tensile strength obtained.

TABLE 2

| | Internal Layer | | External Layer | Number of Cycles | | | |
|---|---|---|---|---|---|---|---|
| Comparative Example | Average Grain Size of Crystal Grains (μm) | Nanoscale Precipitates (mass %) | Average Grain Size of Crystal Grains (μm) | to Fracture under Impact Force (million cycles) | Conductivity (% IACS) | Fatigue Strength (MPa) | Tensile Strength of External Layer (MPa) |
| R1 | 2 | 0.05 | 2 | 2.6 | 66 | 130 | 450 |
| R2 | 2 | 1.1 | 2 | 3.5 | 53 | 137 | 450 |
| R3 | 1.5 | 0.05 | 2 | 2.55 | 64 | 135 | 450 |
| R4 | 1.5 | 1.1 | 2 | 3.5 | 53 | 145 | 450 |
| R5 | 2.5 | 0.05 | 2 | 1.9 | 66 | 122 | 450 |
| R6 | 2.5 | 0.1 | 2 | 2.7 | 63 | 144 | 450 |
| R7 | 2.5 | 0.5 | 2 | 2.9 | 62 | 163 | 450 |
| R8 | 2.5 | 1 | 2 | 2.6 | 54 | 140 | 450 |
| R9 | 2.5 | 1.1 | 2 | 2.2 | 52 | 119 | 450 |

Experimental Examples 7 to 12

A composite strand 7 with a diameter of 80 μm was manufactured, including (i) an internal layer composed of a metal texture containing aluminium crystal grains with an average grain size of 2 μm and 0.1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 1.5 μm. A composite strand 8 with a diameter of 80 μm was manufactured, including (i) an internal layer composed of a metal texture containing aluminium crystal grains with an average grain size of 2 μm and 0.5 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 1.5 μm. A composite strand 9 with a diameter of 80 μm was manufactured, including (i) an internal layer composed of a metal texture containing aluminium crystal grains with an average grain size of 2 μm and 1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 1.5 μm. Stranded wires were formed by using the composite strands 7 to 9, and electric wires 7 to 9, each with a cross sectional area of 0.2 $mm^2$, were manufactured by using the stranded wires.

A composite strand 10 with a diameter of 80 μm was manufactured, including (i) an internal layer composed of a metal texture containing aluminium crystal grains with an average grain size of 1.5 μm and 0.1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 1.5 μm. A composite strand 11 with a diameter of 80 μm was manufactured, including (i) an internal layer composed of a metal texture containing aluminium crystal grains with an average grain size of 1.5 μm and 0.5 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 1.5 μm. A composite strand 12 with a diameter of 80 μm was manufactured, including (i) an internal layer composed of a metal texture containing aluminium crystal grains with an average grain size of 1.5 μm and 1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 1.5 μm. Stranded wires were formed by using the composite strands 10 to 12, and electric wires 10 to 12, each with a cross sectional area of 0.2 $mm^2$, were manufactured by using the stranded wires.

The same impact force added bending test as in the experimental examples 1 to 6 was conducted on each of the electric wires 7 to 12 at room temperature to obtain the number of cycles to fracture under impact force. Using the manufactured electric wires 7 to 12, conductivities thereof were obtained. Table 3 shows the number of cycles to fracture under impact force and the conductivity obtained. Like the experimental examples 1 to 6, test specimens 7 to 12 having almost the same sectional structure as the composite strands 7 to 12 on average were manufactured to conduct the fatigue tests. A stress at fracture after $10^6$ cycles of cyclic loading was calculated, which was used as the fatigue strength of the internal layer. Tensile specimens 7 to 12 similar to the ones in the experimental examples 1 to 6 were manufactured to obtain tensile strengths. Table 3 shows the fatigue strength and the tensile strength obtained.

TABLE 3

| | Internal Layer | | External Layer | Number of Cycles | | | |
|---|---|---|---|---|---|---|---|
| Experimental Example | Average Grain Size of Crystal Grains (μm) | Nanoscale Precipitates (mass %) | Average Grain Size of Crystal Grains (μm) | to Fracture under Impact Force (million cycles) | Conductivity (% IACS) | Fatigue Strength (MPa) | Tensile Strength of External Layer (MPa) |
| 7 | 2 | 0.1 | 1.5 | 3.9 | 64 | 156 | 470 |
| 8 | 2 | 0.5 | 1.5 | 5.3 | 62 | 182 | 470 |
| 9 | 2 | 1 | 1.5 | 4.5 | 56 | 155 | 470 |
| 10 | 1.5 | 0.1 | 1.5 | 4.05 | 63 | 165 | 470 |
| 11 | 1.5 | 0.5 | 1.5 | 6.5 | 61 | 209 | 470 |
| 12 | 1.5 | 1 | 1.5 | 4.2 | 54 | 171 | 470 |

Comparative Examples R10 to R18

A composite strand R10 with a diameter of 80 μm was manufactured, including (i) an internal layer composed of a metal texture containing aluminium crystal grains with an average grain size of 2 μm and 0.05 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 1.5 μm. A composite strand R11 with a diameter of 80 μm was manufactured, including (i) an internal layer composed of a metal texture containing aluminium crystal grains with an average grain size of 2 μm and 1.1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 1.5 μm. A composite strand R12 with a diameter of 80 μm was manufactured, including (i) an internal layer composed of a metal texture containing aluminium crystal grains with an average grain size of 1.5 μm and 0.05 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 1.5 μm. A composite strand R13 with a diameter of 80 μm was manufactured, including a composite conductor having (i) an internal layer composed of a metal texture containing aluminium crystal grains with an average grain size of 1.5 μm and 1.1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 1.5 μm. Stranded wires were formed by using the composite strands R10 to R13, and electric wires R10 to R13, each with a cross sectional area of 0.2 $mm^2$, were manufactured by using the stranded wires.

A composite strand R14 with a diameter of 80 μm was manufactured, including (i) an internal layer composed of a metal texture containing aluminium crystal grains with an average grain size of 2.5 μm and 0.05 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 1.5 μm. A composite strand R15 with a diameter of 80 μm was manufactured, including (i) an internal layer composed of a metal texture containing aluminium crystal grains with an average grain size of 2.5 μm and 0.1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 1.5 μm. A composite strand R16 with a diameter of 80 μm was manufactured, including (i) an internal layer composed of a metal texture containing aluminium crystal grains with an average grain size of 2.5 μm and 0.5 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 1.5 μm. A composite strand R17 with a diameter of 80 μm was manufactured, including (i) an internal layer composed of a metal texture containing aluminium crystal grains with an average grain size of 2.5 μm and 1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 1.5 μm. A composite strand R18 with a diameter of 80 μm was manufactured, including a composite conductor having (i) an internal layer composed of a metal texture containing aluminium crystal grains with an average grain size of 2.5 μm and 1.1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 1.5 μm. Stranded wires were formed by using the composite strands R14 to R18, and electric wires R14 to R18, each with a cross sectional area of 0.2 $mm^2$, were manufactured by using the stranded wires.

The same impact force added bending test as in the experimental examples 1 to 6 was conducted on each of the electric wires R10 to R18 at room temperature to obtain the number of cycles to fracture under impact force. Using the manufactured electric wires R10 to R11, conductivities thereof were obtained. Table 4 shows the number of cycles to fracture under impact force and the conductivity obtained. Like the experimental examples 1 to 6, test specimens R10 to R18 having almost the same sectional structure as the composite strands R10 to R18 on average were manufactured to conduct the fatigue tests. A stress at fracture after $10^6$ cycles of cyclic loading was calculated, which was used as the fatigue strength of the internal layer. Tensile specimens R10 to R18 similar to the ones in the experimental examples 1 to 6 were manufactured to obtain tensile strengths. Table 4 shows the fatigue strength and the tensile strength obtained.

TABLE 4

| Comparative Example | Internal Layer: Average Grain Size of Crystal Grains (μm) | Internal Layer: Nanoscale Precipitates (mass %) | External Layer: Average Grain Size of Crystal Grains (μm) | Number of Cycles to Fracture under Impact Force (million cycles) | Conductivity (% IACS) | Fatigue Strength (MPa) | Tensile Strength of External Layer (MPa) |
|---|---|---|---|---|---|---|---|
| R10 | 2 | 0.05 | 1.5 | 2.7 | 66 | 130 | 470 |
| R11 | 2 | 1.1 | 1.5 | 3.8 | 53 | 137 | 470 |
| R12 | 1.5 | 0.05 | 1.5 | 2.9 | 65 | 135 | 470 |
| R13 | 1.5 | 1.1 | 1.5 | 3.6 | 52 | 145 | 470 |
| R14 | 2.5 | 0.05 | 1.5 | 2.2 | 67 | 122 | 470 |
| R15 | 2.5 | 0.1 | 1.5 | 2.9 | 64 | 144 | 470 |
| R16 | 2.5 | 0.5 | 1.5 | 2.9 | 62 | 163 | 470 |
| R17 | 2.5 | 1 | 1.5 | 2.6 | 54 | 140 | 470 |
| R18 | 2.5 | 1.1 | 1.5 | 2.3 | 52 | 119 | 470 |

Comparative Examples R19 to R33

A composite strand R19 with a diameter of 80 μm was manufactured, including (i) an internal layer composed of a metal texture containing aluminium crystal grains with an average grain size of 2 μm and 0.05 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2.5 μm. A composite strand R20 with a diameter of 80 μm was manufactured, including (i) an internal layer composed of a metal texture containing aluminium crystal grains with an average grain size of 2 μm and 1.1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2.5 μm. A composite strand R21 with a diameter of 80 μm was manufactured, including (i) an internal layer composed of a metal texture containing aluminium crystal grains with an average grain size of 2 μm and 0.5 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2.5 μm. A composite strand R22 with a diameter of 80 μm was manufactured, including (i) an internal layer composed of a metal texture containing aluminium crystal grains with an average grain size of 2 μm and 1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2.5 μm. A composite strand R23 with a diameter of 80 μm was manufactured, including (i) an internal layer composed of a metal texture containing aluminium crystal grains with an average grain size of 2 μm and 1.1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2.5 μm. Stranded wires were formed by using the composite strands R19 to R23, and electric wires R19 to R23, each with a cross sectional area of 0.2 $mm^2$, were manufactured by using the stranded wires.

A composite strand R24 with a diameter of 80 μm was manufactured, including (i) an internal layer composed of a metal texture containing aluminium crystal grains with an average grain size of 1.5 μm and 0.05 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2.5 μm. A composite strand R25 with a diameter of 80 μm was manufactured, including (i) an internal layer composed of a metal texture containing aluminium crystal grains with an average grain size of 1.5 μm and 1.1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2.5 μm. A composite strand R26 with a diameter of 80 μm was manufactured, including (i) an internal layer composed of a metal texture containing aluminium crystal grains with an average grain size of 1.5 μm and 0.5 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2.5 μm. A composite strand R27 with a diameter of 80 μm was manufactured, including (i) an internal layer composed of a metal texture containing aluminium crystal grains with an average grain size of 1.5 μm and 1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2.5 μm. A composite strand R28 with a diameter of 80 μm was manufactured, including (i) an internal layer composed of a metal texture containing aluminium crystal grains with an average grain size of 1.5 μm and 1.1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2.5 μm. Stranded wires were formed by using the composite strands R24 to R28, and electric wires R24 to R28, each with a cross sectional area of 0.2 $mm^2$, were manufactured by using the stranded wires.

A composite strand R29 with a diameter of 80 μm was manufactured, including (i) an internal layer composed of a metal texture containing aluminium crystal grains with an average grain size of 2.5 μm and 0.05 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2.5 μm. A composite strand R30 with a diameter of 80 μm was manufactured, including (i) an internal layer composed of a metal texture containing aluminium crystal grains with an average grain size of 2.5 μm and 0.1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2.5 μm. A composite strand R31 with a diameter of 80 μm was manufactured, including (i) an internal layer composed of a metal texture containing aluminium crystal grains with an average grain size of 2.5 μm and 0.5 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2.5 μm. A composite strand R32 with a diameter of 80 μm was manufactured, including (i) an internal layer composed of a metal texture containing aluminium crystal grains with an average grain size of 2.5 μm and 1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2.5 μm. A composite strand R33 with a diameter of 80 μm was manufactured, including (i) an internal layer composed of a metal texture containing aluminium crystal grains with an average grain size of 2.5 μm and 1.1 mass % nanoscale aluminium-scandium precipitates existing in a grain boundary of the aluminium crystal grains and (ii) an external layer (10 μm thick) composed of a metal texture containing crystal grains of a copper silver alloy with an average grain size of 2.5 μm. Stranded wires were formed by using the composite strands R29 to R33, and electric wires R29 to R33, each with a cross sectional area of 0.2 $mm^2$, were manufactured by using the stranded wires.

The same impact force added bending test as in the experimental examples 1 to 6 was conducted on each of the electric wires R19 to R33 at room temperature to obtain the number of cycles to fracture under impact force. Using the manufactured electric wires R19 to R33, conductivities thereof were obtained. Table 5 shows the number of cycles to fracture under impact force and the conductivity obtained. Like the experimental examples 1 to 6, test specimens R19 to R33 having almost the same sectional structure as the composite strands R19 to R33 on average were manufactured to conduct the fatigue tests. A stress at fracture after $10^6$ cycles of cyclic loading was calculated, which was used as the fatigue strength of the internal layer. Tensile specimens R19 to R33 similar to the ones in the experimental examples 1 to 6 were manufactured to obtain tensile strengths. Table 5 shows the fatigue strength and the tensile strength obtained.

TABLE 5

| | Internal Layer | | External Layer | Number of Cycles to | | | |
|---|---|---|---|---|---|---|---|
| Comparative Example | Average Grain Size of Crystal Grains (μm) | Nanoscale Precipitates (mass %) | Average Grain Size of Crystal Grains (μm) | Fracture under Impact Force (million cycles) | Conductivity (% IACS) | Fatigue Strength (MPa) | Tensile Strength of External Layer (MPa) |
| R19 | 2 | 0.05 | 2.5 | 1.8 | 66 | 130 | 425 |
| R20 | 2 | 1.1 | 2.5 | 2.2 | 53 | 137 | 425 |
| R21 | 2 | 0.5 | 2.5 | 2.9 | 62 | 187 | 425 |
| R22 | 2 | 1 | 2.5 | 2.5 | 56 | 155 | 425 |
| R23 | 2 | 1.1 | 2.5 | 2.1 | 53 | 137 | 425 |
| R24 | 1.5 | 0.05 | 2.5 | 1.8 | 65 | 135 | 425 |
| R25 | 1.5 | 1.1 | 2.5 | 2.3 | 66 | 165 | 425 |
| R26 | 1.5 | 0.5 | 2.5 | 2.8 | 61 | 209 | 425 |

TABLE 5-continued

| Comparative Example | Internal Layer: Average Grain Size of Crystal Grains (μm) | Internal Layer: Nanoscale Precipitates (mass %) | External Layer: Average Grain Size of Crystal Grains (μm) | Number of Cycles to Fracture under Impact Force (million cycles) | Conductivity (% IACS) | Fatigue Strength (MPa) | Tensile Strength of External Layer (MPa) |
|---|---|---|---|---|---|---|---|
| R27 | 1.5 | 1 | 2.5 | 2.3 | 55 | 171 | 425 |
| R28 | 1.5 | 1.1 | 2.5 | 2.0 | 52 | 145 | 425 |
| R29 | 2.5 | 0.05 | 2.5 | 1.5 | 66 | 122 | 425 |
| R30 | 2.5 | 0.1 | 2.5 | 1.9 | 64 | 144 | 425 |
| R31 | 2.5 | 0.5 | 2.5 | 2.9 | 62 | 163 | 425 |
| R32 | 2.5 | 1 | 2.5 | 2.7 | 54 | 410 | 425 |
| R33 | 2.5 | 1.1 | 2.5 | 2.4 | 52 | 119 | 425 |

According to the results shown in Tables 1 to 5, it was found that the conductivity was 54% IACS or more and the number of cycles to fracture under impact force was three million times or more when the fatigue strength of the internal layer (subjected to $10^6$ cycles of the cyclic loading) was 150 MPa or more and the tensile strength of the external layer was 450 MPa in the composite conductor including the internal layer composed of the metal texture containing the aluminium crystal grains with the average grain size of 2 μm or less and 0.1 to 1 mass % of the nanoscale aluminium-scandium precipitates existing in the grain boundary of the aluminium crystal grains and the external layer composed of the metal texture containing the crystal grains of the copper silver alloy with the average grain size of 2 μm or less. Thus, when the electric wire manufactured by using this composite conductor is used for, for example, wiring of a drive member of an industrial robot, the reliability of the robot can be improved and a burden of maintenance can be reduced.

Experimental Examples 13 to 16

A composite strand 13 with a diameter of 80 μm was manufactured, including (i) an internal layer composed of a metal texture containing copper crystal grains with an average grain size of 2 μm and (ii) an external layer (10 μm thick) composed of a metal texture containing crystal grains of a copper silver alloy including 5 mass % silver with an average grain size of 2 μm. A composite strand 14 with a diameter of 80 μm was manufactured, including (i) an internal layer composed of a metal texture containing copper crystal grains with an average grain size of 2 μm and (ii) an external layer (10 μm thick) composed of a metal texture containing crystal grains of a copper silver alloy including 5 mass % silver with an average grain size of 1.5 μm. A composite strand 15 with a diameter of 80 μm was manufactured, including (i) an internal layer composed of a metal texture containing copper crystal grains with an average grain size of 1.5 μm and (ii) an external layer (10 μm thick) composed of a metal texture containing crystal grains of a copper silver alloy including 5 mass % silver with an average grain size of 2 μm. A composite strand 16 with a diameter of 80 μm was manufactured, including (i) an internal layer composed of a metal texture containing copper crystal grains with an average grain size of 1.5 μm and (ii) an external layer (10 μm thick) composed of a metal texture containing crystal grains of a copper silver alloy including 5 mass % silver with an average grain size of 1.5 μm. Stranded wires were formed by using the composite strands 13 to 16, and electric wires 13 to 16 each with a cross sectional area of 0.2 $mm^2$ were manufactured by using the stranded wires.

Comparative Examples R34 to R38

A composite strand R34 with a diameter of 80 μm was manufactured, including (i) an internal layer composed of a metal texture containing copper crystal grains with an average grain size of 2 μm and (ii) an external layer (10 μm thick) composed of a metal texture containing crystal grains of a copper silver alloy including 5 mass % silver with an average grain size of 2.5 μm. A composite strand R35 with a diameter of 80 μm was manufactured, including (i) an internal layer composed of a metal texture containing copper crystal grains with an average grain size of 2.5 μm and (ii) an external layer (10 μm thick) composed of a metal texture containing crystal grains of a copper silver alloy including 5 mass % silver with an average grain size of 1.5 μm. A composite strand R36 with a diameter of 80 μm was manufactured, including (i) an internal layer composed of a metal texture containing copper crystal grains with an average grain size of 2.5 μm and (ii) an external layer (10 μm thick) composed of a metal texture containing crystal grains of a copper silver alloy including 5 mass % silver with an average grain size of 2.5 μm. A composite strand R37 with a diameter of 80 μm was manufactured, including (i) an internal layer composed of a metal texture containing copper crystal grains with an average grain size of 2.5 μm and (ii) an external layer (10 μm thick) composed of a metal texture containing crystal grains of a copper silver alloy including 5 mass % silver with an average grain size of 2 μm. A composite strand R38 with a diameter of 80 μm was manufactured, including (i) an internal layer composed of a metal texture containing copper crystal grains with an average grain size of 2.5 μm and (ii) an external layer (10 μm thick) composed of a metal texture containing crystal grains of a copper silver alloy including 5 mass % silver with an average grain size of 1.5 μm. Stranded wires were formed by using the composite strands R34 to R38, and electric wires R34 to R38, each with a cross sectional area of 0.2 $mm^2$, were manufactured by using the stranded wires.

The same impact force added bending test as in the experimental examples 1 to 6 was conducted on each of the electric wires 13 to 16 and R34 to R38 at room temperature to obtain the number of cycles to fracture under impact force. Table 6 shows the number of cycles to fracture under impact obtained. Like the experimental examples 1 to 6, test specimens 13 to 16 and R34 to R38 having almost the same sectional structure as the composite strands 13 to 16 and R34 to R38 on average were manufactured to conduct the fatigue tests. A stress at fracture after $10^6$ cycles of cyclic loading was calculated, which was used as the fatigue strength of the internal layer. Tensile specimens 13 to 16 and R34 to R38 similar to the ones in the experimental examples 1 to 6 were manufactured to obtain tensile strengths. Further, tensile specimens 13' to 16' and R34' to R38', which had almost the same sectional structure as the composite strands 13 to 16 and R34 to R38 on average were manufactured to measure the tensile strengths, in which each of the tensile specimens had a length of 31 mm, a width of 8.5 mm, and a thickness of 1 mm. Then, a strength ratio $\sigma_B/\sigma_A$ of tensile strength $\sigma_B$ of the external layer to tensile strength $\sigma_A$ of the internal layer was obtained. Table 6 shows the fatigue strength and the strength ratio obtained.

TABLE 6

| Experimental Example/ Comparative Example | Inernal Layer Average Grain Size of Crystal Grains (μm) | External Layer Average Grain Size of Crystal Grains (μm) | Number of Cycles to Fracture under Impact Force (million cycles) | Strength Ratio | Fatigue Strength (MPa) | Tensile Strength of External Layer (MPa) |
|---|---|---|---|---|---|---|
| 13 | 2 | 2 | 3.5 | 1.6 | 202 | 450 |
| 14 | 2 | 1.5 | 4.0 | 1.6 | 202 | 450 |
| 15 | 1.5 | 2 | 3.5 | 1.6 | 211 | 450 |
| 16 | 1.5 | 1.5 | 4.5 | 1.6 | 211 | 450 |
| R34 | 2 | 2.5 | 2.6 | 1.6 | 202 | 450 |
| R35 | 2.5 | 1.5 | 2.8 | 1.6 | 177 | 450 |
| R36 | 2.5 | 2.5 | 2.75 | 1.6 | 177 | 450 |
| R37 | 2.5 | 2 | 2.5 | 1.6 | 177 | 450 |
| R38 | 2.5 | 1.5 | 2.6 | 1.6 | 177 | 450 |

Experimental Examples 17 to 20

A composite strand 17 with a diameter of 80 μm was manufactured, including (i) an internal layer composed of a metal texture containing copper crystal grains with an average grain size of 2 μm and (ii) an external layer (10 μm thick) composed of a metal texture containing crystal grains of a copper silver alloy including 5.2 mass % silver with an average grain size of 2 μm. A composite strand 18 with a diameter of 80 μm was manufactured, including (i) an internal layer composed of a metal texture containing copper crystal grains with an average grain size of 2 μm and (ii) an external layer (10 μm thick) composed of a metal texture containing crystal grains of a copper silver alloy including 5.2 mass % silver with an average grain size of 1.5 μm. A composite strand 19 with a diameter of 80 μm was manufactured, including (i) an internal layer composed of a metal texture containing copper crystal grains with an average grain size of 1.5 μm and (ii) an external layer (10 μm thick) composed of a metal texture containing crystal grains of a copper silver alloy including 5.2 mass % silver with an average grain size of 2 μm. A composite strand 20 with a diameter of 80 μm was manufactured, including (i) an internal layer composed of a metal texture containing copper crystal grains with an average grain size of 1.5 μm and (ii) an external layer (10 μm thick) composed of a metal texture containing crystal grains of a copper silver alloy including 5.2 mass % silver with an average grain size of 1.5 μm. Stranded wires were formed by using the composite strands 17 to 20, and electric wires 17 to 20, each with a cross sectional area of 0.2 $mm^2$, were manufactured by using the stranded wires.

Comparative Examples R39 to R43

A composite strand R39 with a diameter of 80 μm was manufactured, including (i) an internal layer composed of a metal texture containing copper crystal grains with an average grain size of 2.5 μm and (ii) an external layer (10 μm thick) composed of a metal texture containing crystal grains of a copper silver alloy including 5.2 mass % silver with an average grain size of 2.5 μm. A composite strand R40 with a diameter of 80 μm was manufactured, including (i) an internal layer composed of a metal texture containing copper crystal grains with an average grain size of 2.5 μm and (ii) an external layer (10 μm thick) composed of a metal texture containing crystal grains of a copper silver alloy including 5.2 mass % silver with an average grain size of 2.5 μm. A composite strand R41 with a diameter of 80 μm was manufactured, including (i) an internal layer composed of a metal texture containing copper crystal grains with an average grain size of 2.5 μm and (ii) an external layer (10 μm thick) composed of a metal texture containing crystal grains of a copper silver alloy including 5.2 mass % silver with an average grain size of 2.5 μm. A composite strand R42 with a diameter of 80 μm was manufactured, including (i) an internal layer composed of a metal texture containing copper crystal grains with an average grain size of 2.5 μm and (ii) an external layer (10 μm thick) composed of a metal texture containing crystal grains of a copper silver alloy including 5.2 mass % silver with an average grain size of 2 μm. A composite strand R43 with a diameter of 80 μm was manufactured, including (i) an internal layer composed of a metal texture containing copper crystal grains with an average grain size of 2.5 μm and (ii) an external layer (10 μm thick) composed of a metal texture containing crystal grains of a copper silver alloy including 5.2 mass % silver with an average grain size of 1.5 μm. Stranded wires were formed by using the composite strands R39 to R43, and electric wires R39 to R43, each with a cross sectional area of 0.2 $mm^2$, were manufactured by using the stranded wires.

The same impact force added bending test as in the experimental examples 1 to 6 was conducted on each of the electric wires 17 to 20 and R39 to R43 at room temperature to obtain the number of cycles to fracture under impact force. Table 7 shows the number of cycles to fracture under impact obtained. Like the experimental examples 1 to 6, test specimens 17 to 20 and R39 to R43 having almost the same sectional structure as the composite strands 17 to 20 and R39 to R43 on average were manufactured to conduct the fatigue tests. A stress at fracture after $10^6$ cycles of cyclic loading was calculated, which was used as the fatigue strength of the internal layer. Tensile specimens 17 to 20 and R39 to R43 similar to the ones in the experimental examples 1 to 6 were manufactured to obtain tensile strengths. Further, tensile specimens 17' to 20' and R39' to R43', which had almost the same sectional structure as the composite strands 17 to 20 and R39 to R43 on average were manufactured to measure the tensile strengths, in which each of the tensile specimens had a length of 31 mm, a width of 8.5 mm, and a thickness of 1 mm. Then, a strength ratio $\sigma_B/\sigma_A$ of tensile strength $\sigma_B$ of the external layer to tensile strength $\sigma_A$ of the internal layer was obtained. Table 7 shows the fatigue strength and the strength ratio obtained.

TABLE 7

| Experimental Example/ Comparative Example | Inernal Layer Average Grain Size of Crystal Grains (μm) | External Layer Average Grain Size of Crystal Grains (μm) | Number of Cycles to Fracture under Impact Force (million cycles) | Strength Ratio | Fatigue Strength (MPa) | Tensile Strength of External Layer (MPa) |
|---|---|---|---|---|---|---|
| 17 | 2 | 2 | 3.3 | 1.7 | 202 | 470 |
| 18 | 2 | 1.5 | 3.9 | 1.7 | 202 | 470 |
| 19 | 1.5 | 2 | 3.6 | 1.7 | 211 | 470 |
| 20 | 1.5 | 1.5 | 4.5 | 1.7 | 211 | 470 |
| R39 | 2.5 | 2.5 | 2.7 | 1.7 | 177 | 470 |
| R40 | 2.5 | 2.5 | 2.65 | 1.7 | 177 | 470 |
| R41 | 2.5 | 2.5 | 2.7 | 1.7 | 177 | 470 |
| R42 | 2.5 | 2 | 2.6 | 1.7 | 177 | 470 |
| R43 | 2.5 | 1.5 | 2.65 | 1.7 | 177 | 470 |

Comparative Examples R44 to R52

A composite strand R44 with a diameter of 80 μm was manufactured, including (i) an internal layer composed of a metal texture containing copper crystal grains with an average grain size of 2 μm and (ii) an external layer (10 μm thick) composed of a metal texture containing crystal grains of a copper silver alloy including 4.8 mass % silver with an average grain size of 2.5 μm. A composite strand R45 with a diameter of 80 μm was manufactured, including (i) an internal layer composed of a metal texture containing copper crystal grains with an average grain size of 2 μm and (ii) an external layer (10 μm thick) composed of a metal texture containing crystal grains of a copper silver alloy including 4.8 mass % silver with an average grain size of 2 μm. A composite strand R46 with a diameter of 80 μm was manufactured, including (i) an internal layer composed of a metal texture containing copper crystal grains with an average grain size of 2 μm and (ii) an external layer (10 μm thick) composed of a metal texture containing crystal grains of a copper silver alloy including 4.8 mass % silver with an average grain size of 1.5 μm. A composite strand R47 with a diameter of 80 μm was manufactured, including (i) an internal layer composed of a metal texture containing copper crystal grains with an average grain size of 1.5 μm and (ii) an external layer (10 μm thick) composed of a metal texture containing crystal grains of a copper silver alloy including 4.8 mass % silver with an average grain size of 2.5 μm. A composite strand R48 with a diameter of 80 μm was manufactured, including (i) an internal layer composed of a metal texture containing copper crystal grains with an average grain size of 1.5 μm and (ii) an external layer (10 μm thick) composed of a metal texture containing crystal grains of a copper silver alloy including 4.8 mass % silver with an average grain size of 2 μm. A composite strand R49 with a diameter of 80 μm was manufactured, including (i) an internal layer composed of a metal texture containing copper crystal grains with an average grain size of 1.5 μm and (ii) an external layer (10 μm thick) composed of a metal texture containing crystal grains of a copper silver alloy including 4.8 mass % silver with an average grain size of 1.5 μm. A composite strand R50 with a diameter of 80 μm was manufactured, including (i) an internal layer composed of a metal texture containing copper crystal grains with an average grain size of 2.5 μm and (ii) an external layer (10 μm thick) composed of a metal texture containing crystal grains of a copper silver alloy including 4.8 mass % silver with an average grain size of 2.5 μm. A composite strand R51 with a diameter of 80 μm was manufactured, including (i) an internal layer composed of a metal texture containing copper crystal grains with an average grain size of 2.5 μm and (ii) an external layer (10 μm thick) composed of a metal texture containing crystal grains of a copper silver alloy including 4.8 mass % silver with an average grain size of 2 μm. A composite strand R52 with a diameter of 80 μm was manufactured, including (i) an internal layer composed of a metal texture containing copper crystal grains with an average grain size of 2.5 μm and (ii) an external layer (10 μm thick) composed of a metal texture containing crystal grains of a copper silver alloy including 4.8 mass % silver with an average grain size of 1.5 μm. Stranded wires were formed by using the composite strands R44 to R52, and electric wires R44 to R52, each with a cross sectional area of 0.2 $mm^2$, were manufactured by using the stranded wires.

The same impact force added bending test as in the experimental examples 1 to 6 was conducted on each of the electric wires R44 to R52 at room temperature to obtain the number of cycles to fracture under impact force. Table 8 shows the number of cycles to fracture under impact obtained. Like the experimental examples 1 to 6, test specimens R44 to R52 having almost the same sectional structure as the composite strands R44 to R52 on average were manufactured to conduct the fatigue tests. A stress at fracture after $10^6$ cycles of cyclic loading was calculated, which was used as the fatigue strength of the internal layer. Tensile specimens R44 to R52 similar to the ones in the experimental examples 1 to 6 were manufactured to obtain tensile strengths. Further, tensile specimens R44' to R52', which had almost the same sectional structure as the internal layers of composite strands R44 to R52 on average were manufactured to measure the tensile strengths, in which each of the tensile specimens had a length of 31 mm, a width of 8.5 mm, and a thickness of 1 mm. Then, a strength ratio $\sigma_B/\sigma_A$ of tensile strength $\sigma_B$ of the external layer to tensile strength $\sigma_A$ of the internal layer was obtained. Table 8 shows the fatigue strength and the strength ratio obtained.

TABLE 8

| Experimental Example/ Comparative Example | Inernal Layer Average Grain Size of Crystal Grains (μm) | External Layer Average Grain Size of Crystal Grains (μm) | Number of Cycles to Fracture under Impact Force (million cycles) | Strength Ratio | Fatigue Strength (MPa) | Tensile Strength of External Layer (MPa) |
|---|---|---|---|---|---|---|
| R44 | 2 | 2.5 | 2.2 | 1.5 | 202 | 425 |
| R45 | 2 | 2 | 2.7 | 1.5 | 202 | 425 |
| R46 | 2 | 1.5 | 2.9 | 1.5 | 202 | 425 |
| R47 | 1.5 | 2.5 | 2.3 | 1.5 | 211 | 425 |
| R48 | 1.5 | 2 | 2.7 | 1.5 | 211 | 425 |
| R49 | 1.5 | 1.5 | 2.9 | 1.5 | 211 | 425 |
| R50 | 2.5 | 2.5 | 1.9 | 1.5 | 177 | 425 |
| R51 | 2.5 | 2 | 2.1 | 1.5 | 177 | 425 |
| R52 | 2.5 | 1.5 | 2.3 | 1.5 | 177 | 425 |

According to the results shown in Tables 6 to 8, it was found that the number of cycles to fracture under impact force was three million times or more when the fatigue strength of the internal layer (subjected to $10^6$ cycles of the cyclic loading) was 150 MPa or more, the tensile strength of the external layer was 250 MPa or more, and the strength ratio $\sigma_B/\sigma_A$ was 1.6 or more in the composite conductor including the internal layer composed of the metal texture containing the copper crystal grains with the average grain size of 2 μm or less and the external layer composed of the metal texture containing the crystal grains of the copper silver alloy with the average grain size of 2 μm or less. Thus, when the electric wire manufactured by using this compound conductor is used for, for example, wiring of a drive member of an industrial robot, the reliability of the robot can be improved and a burden of maintenance can be reduced.

Experimental Examples 21 to 26

A composite strand 21 with a diameter of 80 μm was manufactured, including (i) an internal layer composed of a metal texture containing aluminium crystal grains with an average grain size of 2 μm and 0.1 mass % nanoscale aluminium-scandium precipitates existing in a grain boundary of the aluminium crystal grains and (ii) an external layer (10 μm thick) composed of a metal texture containing crystal grains of a silver-based alloy (including 8 mass % zinc, 8 mass % tin, and 4 mass % indium, the same applies hereinafter) with an average grain size of 2 μm. A composite strand 22 with a diameter of 80 μm was manufactured, including (i) an internal layer composed of a metal texture containing aluminium crystal grains with an average grain size of 2 μm and 0.5 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2 μm. A composite strand 23 with a diameter of 80 μm was manufactured, including (i) an internal layer composed of a metal texture containing aluminium crystal grains with an average grain size of 2 μm and 1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2 μm. Stranded wires were formed by using the composite strands 21 to 23, and electric wires 21 to 23, each with a cross sectional area of 0.2 $mm^2$, were manufactured by using the stranded wires.

A composite strand 24 with a diameter of 80 μm was manufactured, including (i) an internal layer composed of a metal texture containing aluminium crystal grains with an average grain size of 1.5 μm and 0.1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2 μm. A composite strand 25 with a diameter of 80 μm was manufactured, including (i) an internal layer composed of a metal texture containing aluminium crystal grains with an average grain size of 1.5 μm and 0.5 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2 μm. A composite strand 26 with a diameter of 80 μm was manufactured, including (i) an internal layer composed of a metal texture containing aluminium crystal grains with an average grain size of 1.5 μm and 1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2 μm. Stranded wires were formed by using the composite strands 24 to 26, and electric wires 24 to 26, each with a cross sectional area of 0.2 $mm^2$, were manufactured by using the stranded wires.

A cyclic bending test was conducted on each of the electric wires 21 to 26 to obtain the number of cycles to fracture, in which the cyclic bending from side to side with a bending radius of 15 mm and a bending angle range of +90 degrees was applied to each of the electric wires 21 to 26 with a 100-g load loaded at room temperature. Using the manufactured electric wires 21 to 26, conductivities thereof were obtained. Table 9 shows the number of cycles to fracture under impact force and the conductivity obtained. Like the experimental examples 1 to 6, test specimens 21 to 26 having almost the same sectional structure as the composite strands 21 to 26 on average were manufactured to conduct the fatigue tests. A stress at fracture after $10^6$ cycles of cyclic loading was calculated, which was used as the fatigue strength of the internal layer. Tensile specimens 21 to 26 similar to the ones in the experimental examples 1 to 6 were manufactured to obtain tensile strengths. Table 9 shows the fatigue strength and the tensile strength obtained.

TABLE 9

| | Internal Layer | | External Layer | | | | |
|---|---|---|---|---|---|---|---|
| Experimental Example | Average Grain Size of Crystal Grains (μm) | Nanoscale Precipitates (mass %) | Average Grain Size of Crystal Grains (μm) | Number of Cycles to Fracture (million cycles) | Conductivity (% IACS) | Fatigue Strength (MPa) | Tensile Strength of External Layer (MPa) |
| 21 | 2 | 0.1 | 2 | 3.1 | 64 | 156 | 270 |
| 22 | 2 | 0.5 | 2 | 4.8 | 62 | 182 | 270 |
| 23 | 2 | 1 | 2 | 3.3 | 56 | 155 | 270 |
| 24 | 1.5 | 0.1 | 2 | 3.5 | 63 | 165 | 270 |
| 25 | 1.5 | 0.5 | 2 | 5.4 | 61 | 209 | 270 |
| 26 | 1.5 | 1 | 2 | 3.4 | 55 | 171 | 270 |

Comparative Examples R53 to R61

A composite strand R53 with a diameter of 80 μm was manufactured, including (i) an internal layer composed of a metal texture containing aluminium crystal grains with an average grain size of 2 μm and 0.05 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2 μm. A composite strand R54 with a diameter of 80 μm was manufactured, including (i) an internal layer composed of a metal texture containing aluminium crystal grains with an average grain size of 2 μm and 1.1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2 μm. A composite strand R55 with a diameter of 80 μm was manufactured, including (i) an internal layer composed of a metal texture containing aluminium crystal grains with an average grain size of 1.5 μm and 0.05 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2 μm. A composite strand R56 with a diameter of 80 μm was manufactured, including (i) an internal layer composed of a metal texture containing aluminium crystal grains with an average grain size of 1.5 μm and 1.1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2 μm. Stranded wires were formed by using the composite strands R53 to R56, and electric wires R53 to R56, each with a cross sectional area of 0.2 $mm^2$, were manufactured by using the stranded wires.

A composite strand R57 with a diameter of 80 μm was manufactured, including (i) an internal layer composed of a metal texture containing aluminium crystal grains with an average grain size of 2.5 μm and 0.05 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2 μm. A composite strand R58 with a diameter of 80 μm was manufactured, including (i) an internal layer composed of a metal texture containing aluminium crystal grains with an average grain size of 2.5 μm and 0.1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2 μm. A composite strand R59 with a diameter of 80 μm was manufactured, including (i) an internal layer composed of a metal texture containing aluminium crystal grains with an average grain size of 2.5 μm and 0.5 mass % nanoscale aluminium-scandium precipitates existing in a grain boundary of the aluminium grains and (ii) an external layer (10 μm thick) composed of a metal texture containing crystal grains of a silver-based alloy with an average grain size of 2 μm. A composite strand R60 with a diameter of 80 μm was manufactured, including (i) an internal layer composed of a metal texture containing aluminium crystal grains with an average grain size of 2.5 μm and 1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2 μm. A composite strand R61 with a diameter of 80 μm was manufactured, including (i) an internal layer composed of a metal texture containing aluminium crystal grains with an average grain size of 2.5 μm and 1.1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2 μm. Stranded wires were formed by using the composite strands R57 to R61, and electric wires R57 to R61, each with a cross sectional area of 0.2 $mm^2$, were manufactured by using the stranded wires.

The same cyclic bending test as in the experimental examples 21 to 26 was conducted on each of the electric wires R53 to R61 at room temperature to obtain the number of cycles to fracture. Using the manufactured electric wires R53 to R61, conductivities thereof were obtained. Table 10 shows the number of cycles to fracture under impact force and the conductivity obtained. Like the experimental examples 1 to 6, test specimens R53 to R61 having almost the same sectional structure as the composite strands R53 to R61 on average were manufactured to conduct the fatigue tests. A stress at fracture after $10^6$ cycles of cyclic loading was calculated, which was used as the fatigue strength of the internal layer. Tensile specimens R53 to R61 similar to the ones in the experimental examples 1 to 6 were manufactured to obtain tensile strengths. Table 10 shows the fatigue strength and the tensile strength obtained.

TABLE 10

| | Internal Layer | | External Layer | | | | |
|---|---|---|---|---|---|---|---|
| Comparative Example | Average Grain Size of Crystal Grains (μm) | Nanoscale Precipitates (mass %) | Average Grain Size of Crystal Grains (μm) | Number of Cycles to Fracture (million cycles) | Conductivity (% IACS) | Fatigue Strength (MPa) | Tensile Strength of External Layer (MPa) |
| R53 | 2 | 0.05 | 2 | 2.5 | 66 | 130 | 270 |
| R54 | 2 | 1.1 | 2 | 2.8 | 53 | 137 | 270 |
| R55 | 1.5 | 0.05 | 2 | 2.8 | 64 | 135 | 270 |
| R56 | 1.5 | 1.1 | 2 | 2.9 | 53 | 145 | 270 |
| R57 | 2.5 | 0.05 | 2 | 1.8 | 66 | 122 | 270 |
| R58 | 2.5 | 0.1 | 2 | 2.0 | 63 | 144 | 270 |
| R59 | 2.5 | 0.5 | 2 | 2.8 | 62 | 163 | 270 |
| R60 | 2.5 | 1 | 2 | 2.3 | 54 | 140 | 270 |
| R61 | 2.5 | 1.1 | 2 | 2.3 | 52 | 119 | 270 |

Experimental Examples 27 to 32

A composite strand 27 with a diameter of 80 μm was manufactured, including (i) an internal layer composed of a metal texture containing aluminium crystal grains with an average grain size of 2 μm and 0.1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 1.5 μm. A composite strand 28 with a diameter of 80 μm was manufactured, including (i) an internal layer composed of a metal texture containing aluminium crystal grains with an average grain size of 2 μm and 0.5 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 1.5 μm. A composite strand 29 with a diameter of 80 μm was manufactured, including (i) an internal layer composed of a metal texture containing aluminium crystal grains with an average grain size of 2 μm and 1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 1.5 μm. Stranded wires were formed by using the composite strands 27 to 29, and electric wires 27 to 29, each with a cross sectional area of 0.2 $mm^2$, were manufactured by using the stranded wires.

A composite strand 30 with a diameter of 80 μm was manufactured, including (i) an internal layer composed of a metal texture containing aluminium crystal grains with an average grain size of 1.5 μm and 0.1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 1.5 μm. A composite strand 31 with a diameter of 80 μm was manufactured, including (i) an internal layer composed of a metal texture containing aluminium crystal grains with an average grain size of 1.5 μm and 0.5 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 1.5 μm. A composite strand 32 with a diameter of 80 μm was manufactured, including (i) an internal layer composed of a metal texture containing aluminium crystal grains with an average grain size of 1.5 μm and 1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 1.5 μm. Stranded wires were formed by using the composite strands 30 to 32, and electric wires 30 to 32 each, with a cross sectional area of 0.2 $mm^2$, were manufactured by using the stranded wires.

The same cyclic bending test as in the experimental examples 21 to 26 was conducted on each of the electric wires 27 to 32 at room temperature to obtain the number of cycles to fracture. Using the manufactured electric wires 27 to 32, conductivities thereof were obtained. Table 11 shows the number of cycles to fracture under impact force and the conductivity obtained. Like the experimental examples 1 to 6, test specimens 27 to 32 having almost the same sectional structure as the composite strands 27 to 32 on average were manufactured to conduct the fatigue tests. A stress at fracture after $10^6$ cycles of cyclic loading was calculated, which was used as the fatigue strength of the internal layer. Tensile specimens 27 to 32 similar to the ones in the experimental examples 1 to 6 were manufactured to obtain tensile strengths. Table 11 shows the fatigue strength and the tensile strength obtained.

TABLE 11

| | Internal Layer | | External Layer | | | | |
|---|---|---|---|---|---|---|---|
| Experimental Example | Average Grain Size of Crystal Grains (μm) | Nanoscale Precipitates (mass %) | Average Grain Size of Crystal Grains (μm) | Number of Cycles to Fracture (million cycles) | Conductivity (% IACS) | Fatigue Strength (MPa) | Tensile Strength of External Layer (MPa) |
| 27 | 2 | 0.1 | 1.5 | 3.55 | 65 | 156 | 280 |
| 28 | 2 | 0.5 | 1.5 | 4.9 | 62 | 182 | 280 |
| 29 | 2 | 1 | 1.5 | 3.6 | 57 | 155 | 280 |
| 30 | 1.5 | 0.1 | 1.5 | 3.55 | 64 | 165 | 280 |
| 31 | 1.5 | 0.5 | 1.5 | 5.5 | 62 | 209 | 280 |
| 32 | 1.5 | 1 | 1.5 | 3.6 | 55 | 171 | 280 |

Comparative Examples R62 to R70

A composite strand R62 with a diameter of 80 μm was manufactured, including (i) an internal layer composed of a metal texture containing aluminium crystal grains with an average grain size of 2 μm and 0.05 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 1.5 μm. A composite strand R63 with a diameter of 80 μm was manufactured, including (i) an internal layer composed of a metal texture containing aluminium crystal grains with an average grain size of 2 μm and 1.1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 1.5 μm. A composite strand R64 with a diameter of 80 μm was manufactured, including (i) an internal layer composed of a metal texture containing aluminium crystal grains with an average grain size of 1.5 μm and 0.05 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 1.5 μm. A composite strand R65 with a diameter of 80 μm was manufactured, including (i) an internal layer composed of a metal texture containing aluminium crystal grains with an average grain size of 1.5 μm and 1.1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 1.5 μm. Stranded wires were formed by using the composite strands R62 to R65, and electric wires R62 to R65, each with a cross sectional area of 0.2 $mm^2$, were manufactured by using the stranded wires.

A composite strand R66 with a diameter of 80 μm was manufactured, including (i) an internal layer composed of a metal texture containing aluminium crystal grains with an average grain size of 2.5 μm and 0.05 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 1.5 μm. A composite strand R67 with a diameter of 80 μm was manufactured, including (i) an internal layer composed of a metal texture containing aluminium crystal grains with an average grain size of 2.5 μm and 0.1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 1.5 μm. A composite strand R68 with a diameter of 80 μm was manufactured, including (i) an internal layer composed of a metal texture containing aluminium crystal grains with an average grain size of 2.5 μm and 0.5 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 1.5 μm. A composite strand R69 with a diameter of 80 μm was manufactured, including (i) an internal layer composed of a metal texture containing aluminium crystal grains with an average grain size of 2.5 μm and 1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 1.5 μm. A composite strand R70 with a diameter of 80 μm was manufactured from a composite conductor which includes (i) an internal layer composed of a metal texture containing aluminium crystal grains with an average grain size of 2.5 μm and 1.1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 1.5 μm. Stranded wires were formed by using the obtained composite strands R66 to R70 to manufacture electric wires R66 to R70 each having a cross sectional area of 0.2 $mm^2$.

The same cyclic bending test as in the experimental examples 21 to 26 was conducted on each of the electric wires R62 to R70 at room temperature to obtain the number of cycles to fracture. Using the manufactured electric wires R62 to R70, conductivities thereof were obtained. Table 12 shows the number of cycles to fracture under impact force and the conductivity obtained. Like the experimental examples 1 to 6, test specimens R62 to R70 having almost the same sectional structure as the composite strands R62 to R70 on average were manufactured to conduct the fatigue tests. A stress at fracture after $10^6$ cycles of cyclic loading was calculated, which was used as the fatigue strength of the internal layer. Tensile specimens R62 to R70 similar to the ones in the experimental examples 1 to 6 were manufactured to obtain tensile strengths. Table 12 shows the fatigue strength and the tensile strength obtained.

TABLE 12

| Comparative Example | Internal Layer: Average Grain Size of Crystal Grains (μm) | Internal Layer: Nanoscale Precipitates (mass %) | External Layer Average Grain Size of Crystal Grains (μm) | Number of Cycles to Fracture (million cycles) | Conductivity (% IACS) | Fatigue Strength (MPa) | Tensile Strength of External Layer (MPa) |
|---|---|---|---|---|---|---|---|
| R62 | 2 | 0.05 | 1.5 | 2.8 | 67 | 130 | 280 |
| R63 | 2 | 1.1 | 1.5 | 4.7 | 54 | 137 | 280 |
| R64 | 1.5 | 0.05 | 1.5 | 2.85 | 66 | 135 | 280 |
| R65 | 1.5 | 1.1 | 1.5 | 2.95 | 52 | 145 | 280 |
| R66 | 2.5 | 0.05 | 1.5 | 1.7 | 67 | 122 | 280 |
| R67 | 2.5 | 0.1 | 1.5 | 1.9 | 64 | 144 | 280 |
| R68 | 2.5 | 0.5 | 1.5 | 2.9 | 63 | 163 | 280 |
| R69 | 2.5 | 1 | 1.5 | 2.5 | 55 | 140 | 280 |
| R70 | 2.5 | 1.1 | 1.5 | 2.4 | 52 | 119 | 280 |

Comparative Examples R71 to R85

A composite strand R71 with a diameter of 80 μm was manufactured, including (i) an internal layer composed of a metal texture containing aluminium crystal grains with an average grain size of 2 μm and 0.05 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2.5 μm. A composite strand R72 with a diameter of 80 μm was manufactured, including (i) an internal layer composed of a metal texture containing aluminium crystal grains with an average grain size of 2 μm and 1.1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2.5 μm. A composite strand R73 with a diameter of 80 μm was manufactured, including (i) an internal layer composed of a metal texture containing aluminium crystal grains with an average grain size of 2 μm and 0.5 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2.5 μm. A composite strand R74 with a diameter of 80 μm was manufactured, including (i) an internal layer composed of a metal texture containing aluminium crystal grains with an average grain size of 2 μm and 1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2.5 μm. A composite strand R75 with a diameter of 80 μm was manufactured, including (i) an internal layer composed of a metal texture containing aluminium crystal grains with an average grain size of 2 μm and 1.1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2.5 μm. Stranded wires were formed by using the composite strands R71 to R75, and electric wires R71 to R75, each with a cross sectional area of 0.2 $mm^2$, were manufactured by using the stranded wires.

A composite strand R76 with a diameter of 80 μm was manufactured, including (i) an internal layer composed of a metal texture containing aluminium crystal grains with an average grain size of 1.5 μm and 0.05 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2.5 μm. A composite strand R77 with a diameter of 80 μm was manufactured, including (i) an internal layer composed of a metal texture containing aluminium crystal grains with an average grain size of 1.5 μm and 1.1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2.5 μm. A composite strand R78 with a diameter of 80 μm was manufactured, including (i) an internal layer composed of a metal texture containing aluminium crystal grains with an average grain size of 1.5 μm and 0.5 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2.5 μm. A composite strand R79 with a diameter of 80 μm was manufactured, including (i) an internal layer composed of a metal texture containing aluminium crystal grains with an average grain size of 1.5 μm and 1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2.5 μm. A composite strand R80 with a diameter of 80 μm was manufactured, including (i) an internal layer composed of a metal texture containing aluminium crystal grains with an average grain size of 1.5 μm and 1.1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2.5 μm. Stranded wires were formed by using the composite strands R76 to R80, and electric wires R76 to R80, each with a cross sectional area of 0.2 $mm^2$, were manufactured by using the stranded wires.

A composite strand R81 with a diameter of 80 μm was manufactured, including (i) an internal layer composed of a metal texture containing aluminium crystal grains with an average grain size of 2.5 μm and 0.05 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2.5 μm. A composite strand R82 with a diameter of 80 μm was manufactured, including (i) an internal layer composed of a metal texture containing aluminium crystal grains with an average grain size of 2.5 μm and 1.1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2.5 μm. A composite strand R83 with a diameter of 80 μm was manufactured, including (i) an internal layer composed of a metal texture containing aluminium crystal grains with an average grain size of 2.5 μm and 0.5 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2.5 μm. A composite strand R84 with a diameter of 80 μm was manufactured, including (i) an internal layer composed of a metal texture containing aluminium crystal grains with an average grain size of 2.5 μm and 1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2.5 μm. A composite strand R85 with a diameter of 80 μm was manufactured, including (i) an internal layer composed of a metal texture containing aluminium crystal grains with an average grain size of 2.5 μm and 1.1 mass % nanoscale aluminium-scandium precipitates existing in a grain boundary of the aluminium crystal grains and (ii) an external layer (10 μm thick) composed of a metal texture containing crystal grains of a silver-based alloy with an average grain size of 2.5 μm. Stranded wires were formed by using the composite strands R81 to R85, and electric wires R81 to R85, each with a cross sectional area of 0.2 $mm^2$, were manufactured by using the stranded wires.

The same cyclic bending test as in the experimental examples 21 to 26 was conducted on each of the electric wires R81 to R85 at room temperature to obtain the number of cycles to fracture. Using the manufactured electric wires R81 to R85, conductivities thereof were obtained. Table 13 shows the number of cycles to fracture under impact force and the conductivity obtained. Like the experimental examples 1 to 6, test specimens R81 to R85 having almost the same sectional structure as the composite strands R81 to R85 on average were manufactured to conduct the fatigue tests. A stress at fracture after $10^6$ cycles of cyclic loading was calculated, which was used as the fatigue strength of the internal layer. Tensile specimens R81 to R85 similar to the ones in the experimental examples 1 to 6 were manufactured to obtain tensile strengths. Table 13 shows the fatigue strength and the tensile strength obtained.

TABLE 13

| Comparative Example | Internal Layer: Average Grain Size of Crystal Grains (μm) | Internal Layer: Nanoscale Precipitates (mass %) | External Layer: Average Grain Size of Crystal Grains (μm) | Number of Cycles to Fracture (million cycles) | Conductivity (% IACS) | Fatigue Strength (MPa) | Tensile Strength of External Layer (MPa) |
|---|---|---|---|---|---|---|---|
| R71 | 2 | 0.05 | 2.5 | 2.15 | 67 | 130 | 260 |
| R72 | 2 | 1.1 | 2.5 | 2.5 | 55 | 156 | 260 |
| R73 | 2 | 0.5 | 2.5 | 2.9 | 62 | 182 | 260 |
| R74 | 2 | 1 | 2.5 | 2.6 | 57 | 155 | 260 |
| R75 | 2 | 1.1 | 2.5 | 2.4 | 53 | 137 | 260 |
| R76 | 1.5 | 0.05 | 2.5 | 2.2 | 67 | 135 | 260 |
| R77 | 1.5 | 1.1 | 2.5 | 2.4 | 54 | 165 | 260 |
| R78 | 1.5 | 0.5 | 2.5 | 2.75 | 62 | 209 | 260 |
| R79 | 1.5 | 1 | 2.5 | 2.45 | 55 | 171 | 260 |
| R80 | 1.5 | 1.1 | 2.5 | 2.05 | 52 | 145 | 260 |
| R81 | 2.5 | 0.05 | 2.5 | 2.0 | 67 | 122 | 260 |
| R82 | 2.5 | 1.1 | 2.5 | 2.0 | 64 | 144 | 260 |
| R83 | 2.5 | 0.5 | 2.5 | 2.8 | 65 | 163 | 260 |
| R84 | 2.5 | 1 | 2.5 | 2.3 | 56 | 140 | 260 |
| R85 | 2.5 | 1.1 | 2.5 | 2.3 | 52 | 119 | 260 |

According to the results shown in Tables 9 to 13, it was found that the conductivity was 55% IACS or more and the number of cycles to fracture under impact force was three million times or more when the fatigue strength of the internal layer (subjected to $10^6$ cycles of the cyclic loading) was 150 MPa or more and the tensile strength of the external layer was 270 MPa or more in the composite conductor including the internal layer composed of the metal texture containing the aluminium crystal grains with the average grain size of 2 μm or less and 0.1 to 1 mass % of the nanoscale aluminium-scandium precipitates existing in the grain boundary of the aluminium crystal grains and the external layer composed of the metal texture containing the crystal grains of the silver-based alloy with the average grain size of 2 μm or less. Thus, when the electric wire manufactured by using this composite conductor is used for, for example, wiring of transporting machines such as an automobile and an aircraft, on which low-frequency oscillation acts constantly, the reliability of the transporting machines can be improved and a burden of maintenance can be reduced.

Experimental Examples 33 to 38

A composite strand 33 with a diameter of 80 μm was manufactured, including (i) an internal layer composed of a metal texture containing aluminium crystal grains with an average grain size of 2 μm and 0.1 mass % nanoscale aluminium-scandium precipitates existing in a grain boundary of the aluminium crystal grains and (ii) an external layer (10 μm thick) composed of a metal texture containing copper crystal grains with an average grain size of 2 μm. A composite strand 34 with a diameter of 80 μm was manufactured, including (i) an internal layer composed of a metal texture containing aluminium crystal grains with an average grain size of 2 μm and 0.5 mass % nanoscale aluminium-scandium precipitates existing in a grain boundary of the aluminium crystal grains and (ii) an external layer (10 μm thick) composed of a metal texture containing copper crystal grains with an average grain size of 2 μm. A composite strand 35 with a diameter of 80 μm was manufactured, including (i) an internal layer composed of a metal texture containing aluminium grains with an average grain size of 2 μm and 1 mass % nanoscale aluminium-scandium precipitates existing in a grain boundary of the aluminium crystal grains and (ii) an external layer (10 μm thick) composed of a metal texture containing copper crystal grains with an average grain size of 2 μm. Stranded wires were formed by using the composite strands 33 to 35, and electric wires 33 to 35, each with a cross sectional area of 0.2 $mm^2$, were manufactured by using the stranded wires.

A composite strand 36 with a diameter of 80 μm was manufactured, including (i) an internal layer composed of a metal texture containing aluminium crystal grains with an average grain size of 1.5 μm (crystal grains with a grain size of 1 μm or less exist 20% by cross sectional area) and 0.1 mass % nanoscale aluminium-scandium precipitates existing in a grain boundary of the aluminium crystal grains and (ii) an external layer (10 μm thick) composed of a metal texture containing copper crystal grains with an average grain size of 2 μm. A composite strand 37 with a diameter of 80 μm was manufactured, including (i) an internal layer composed of a metal texture containing aluminium crystal grains with an average grain size of 1.5 μm (crystal grains with a grain size of 1 μm or less exist 20% by cross sectional area) and 0.5 mass % nanoscale aluminium-scandium precipitates existing in a grain boundary of the aluminium crystal grains and (ii) an external layer (10 μm thick) composed of a metal texture containing copper crystal grains with an average grain size of 2 μm. A composite strand 38 with a diameter of 80 μm was manufactured, including (i) an internal layer composed of a metal texture containing aluminium crystal grains with an average grain size of 1.5 μm (crystal grains with a grain size of 1 μm or less exist 20% by cross sectional area) and 1 mass % nanoscale aluminium-scandium precipitates existing in a grain boundary of the aluminium crystal grains and (ii) an external layer (10 μm thick) composed of a metal texture containing copper crystal grains with an average grain size of 2 μm. Stranded wires were formed by using the composite strands 36 to 38, and electric wires 36 to 38, each with a cross sectional area of 0.2 $mm^2$, were manufactured by using the stranded wires.

The same impact force added bending test as in the experimental examples 1 to 6 was conducted on each of the electric wires 33 to 38 at room temperature to obtain the number of cycles to fracture under impact force. Using the manufactured electric wires 33 to 38, conductivities thereof were obtained. Table 14 shows the number of cycles to fracture under impact force and the conductivity obtained. Like the experimental examples 1 to 6, test specimens 33 to 38 having almost the same sectional structure as the composite strands 33 to 38 on average were manufactured to conduct the fatigue tests. A stress at fracture after $10^6$ cycles of cyclic loading was calculated, which was used as the fatigue strength of the internal layer. Tensile specimens 33 to 38 similar to the ones in the experimental examples 1 to 6 were manufactured to obtain tensile strengths. Table 14 shows the fatigue strength and the tensile strength obtained.

TABLE 14

| | Internal Layer | | External Layer | Number of Cycles to | | | |
|---|---|---|---|---|---|---|---|
| Experimental Example | Average Grain Size of Crystal Grains (μm) | Nanoscale Precipitates (mass %) | Average Grain Size of Crystal Grains (μm) | Fracture under Impact Force (million cycles) | Conductivity (% IACS) | Fatigue Strength (MPa) | Tensile Strength of External Layer (MPa) |
| 33 | 2 | 0.1 | 2 | 3.0 | 68 | 156 | 250 |
| 34 | 2 | 0.5 | 2 | 4.0 | 66 | 182 | 250 |
| 35 | 2 | 1 | 2 | 3.3 | 60 | 155 | 250 |
| 36 | 1.5 | 0.1 | 2 | 3.3 | 67 | 165 | 250 |
| 37 | 1.5 | 0.5 | 2 | 5.2 | 65 | 209 | 250 |
| 38 | 1.5 | 1 | 2 | 3.5 | 59 | 171 | 250 |

Comparative Examples R86 to R94

A composite strand R86 with a diameter of 80 μm was manufactured, including (i) an internal layer composed of a metal texture containing aluminium crystal grains with an average grain size of 2 μm and 0.05 mass % nanoscale aluminium-scandium precipitates existing in a grain boundary of the aluminium crystal grains and (ii) an external layer (10 μm thick) composed of a metal texture containing copper crystal grains with an average grain size of 2 μm. A composite strand R87 with a diameter of 80 μm was manufactured, including (i) an internal layer composed of a metal texture containing aluminium crystal grains with an average grain size of 2 μm and 1.1 mass % nanoscale aluminium-scandium precipitates existing in a grain boundary of the aluminium crystal grains and (ii) an external layer (10 μm thick) composed of a metal texture containing copper crystal grains with an average grain size of 2 μm. A composite strand R88 with a diameter of 80 μm was manufactured, including (i) an internal layer composed of a metal texture containing aluminium crystal grains with an average grain size of 1.5 μm and 0.05 mass % nanoscale aluminium-scandium precipitates existing in a grain boundary of the aluminium crystal grains and (ii) an external layer (10 μm thick) composed of a metal texture containing copper crystal grains with an average grain size of 2 μm. A composite strand R89 with a diameter of 80 μm was manufactured, including (i) an internal layer composed of a metal texture containing aluminium crystal grains with an average grain size of 1.5 μm and 1.1 mass % nanoscale aluminium-scandium precipitates existing in a grain boundary of the aluminium crystal grains and (ii) an external layer (10 μm thick) composed of a metal texture containing copper crystal grains with an average grain size of 2 μm. Stranded wires were formed by using the composite strands R86 to R89, and electric wires R86 to R89, each with a cross sectional area of 0.2 $mm^2$, were manufactured by using the stranded wires.

A composite strand R90 with a diameter of 80 μm was manufactured, including (i) an internal layer composed of a metal texture containing aluminium crystal grains with an average grain size of 2.5 μm and 0.05 mass % nanoscale aluminium-scandium precipitates existing in a grain boundary of the aluminium crystal grains and (ii) an external layer (10 μm thick) composed of a metal texture containing copper grains with an average grain size of 2 μm. A composite strand R91 with a diameter of 80 μm was manufactured, including (i) an internal layer composed of a metal texture containing aluminium crystal grains with an average grain size of 2.5 μm and 0.1 mass % nanoscale aluminium-scandium precipitates existing in a grain boundary of the aluminium crystal grains and (ii) an external layer (10 μm thick) composed of a metal texture containing copper crystal grains with an average grain size of 2 μm. A composite strand R92 with a diameter of 80 μm was manufactured, including (i) an internal layer composed of a metal texture containing aluminium crystal grains with an average grain size of 2.5 μm and 0.5 mass % nanoscale aluminium-scandium precipitates existing in a grain boundary of the aluminium crystal grains and (ii) an external layer (10 μm thick) composed of a metal texture containing copper crystal grains with an average grain size of 2 μm. A composite strand R93 with a diameter of 80 μm was manufactured, including (i) an internal layer composed of a metal texture containing aluminium crystal grains with an average grain size of 2.5 μm and 1 mass % nanoscale aluminium-scandium precipitates existing in a grain boundary of the aluminium crystal grains and (ii) an external layer (10 μm thick) composed of a metal texture containing copper crystal grains with an average grain size of 2 μm. A composite strand R94 with a diameter of 80 μm was manufactured, including (i) an internal layer composed of a metal texture containing aluminium crystal grains with an average grain size of 2.5 μm and 1.1 mass % nanoscale aluminium-scandium precipitates existing in a grain boundary of the aluminium crystal grains and (ii) an external layer (10 μm thick) composed of a metal texture containing copper crystal grains with an average grain size of 2 μm. Stranded wires were formed by using the composite strands R90 to R94, and electric wires R90 to R94, each with a cross sectional area of 0.2 $mm^2$, were manufactured by using the stranded wires.

The same impact force added bending test as in the experimental examples 1 to 6 was conducted on each of the electric wires R86 to R94 at room temperature to obtain the number of cycles to fracture under impact force. Using the manufactured electric wires R86 to R94, conductivities thereof were obtained. Table 15 shows the number of cycles to fracture under impact force and the conductivity obtained. Like the experimental examples 1 to 6, test specimens R86 to R94 having almost the same sectional structure as the composite strands R86 to R94 on average were manufactured to conduct the fatigue tests. A stress at fracture after $10^6$ cycles of cyclic loading was calculated, which was used as the fatigue strength of the internal layer. Tensile specimens R86 to R94 similar to the ones in the experimental examples 1 to 6 were manufactured to obtain tensile strengths. Table 15 shows the fatigue strength and the tensile strength obtained.

TABLE 15

| Comparative Example | Internal Layer: Average Grain Size of Crystal Grains (μm) | Internal Layer: Nanoscale Precipitates (mass %) | External Layer: Average Grain Size of Crystal Grains (μm) | Number of Cycles to Fracture under Impact Force (million cycles) | Conductivity (% IACS) | Fatigue Strength (MPa) | Tensile Strength of External Layer (MPa) |
|---|---|---|---|---|---|---|---|
| R86 | 2 | 0.05 | 2 | 1.9 | 70 | 130 | 250 |
| R87 | 2 | 1.1 | 2 | 2.75 | 57 | 137 | 250 |
| R88 | 1.5 | 0.05 | 2 | 2.1 | 69 | 135 | 250 |
| R89 | 1.5 | 1.1 | 2 | 2.8 | 56 | 145 | 250 |
| R90 | 2.5 | 0.05 | 2 | 1.7 | 71 | 122 | 250 |
| R91 | 2.5 | 0.1 | 2 | 1.75 | 68 | 144 | 250 |
| R92 | 2.5 | 0.5 | 2 | 2.95 | 66 | 163 | 250 |
| R93 | 2.5 | 1 | 2 | 2.7 | 58 | 140 | 250 |
| R94 | 2.5 | 1.1 | 2 | 2.4 | 56 | 119 | 250 |

Experimental Examples 39 to 44

A composite strand 39 with a diameter of 80 μm was manufactured, including (i) an internal layer composed of a metal texture containing aluminium crystal grains with an average grain size of 2 μm and 0.1 mass % nanoscale aluminium-scandium precipitates existing in a grain boundary of the aluminium crystal grains and (ii) an external layer (10 μm thick) composed of a metal texture containing copper crystal grains with an average grain size of 1.5 μm. A composite strand 40 with a diameter of 80 μm was manufactured, including (i) an internal layer composed of a metal texture containing aluminium crystal grains with an average grain size of 2 μm and 0.5 mass % nanoscale aluminium-scandium precipitates existing in a grain boundary of the aluminium crystal grains and (ii) an external layer (10 μm thick) composed of a metal texture containing copper crystal grains with an average grain size of 1.5 μm. A composite strand 41 with a diameter of 80 μm was manufactured, including (i) an internal layer composed of a metal texture containing aluminium crystal grains with an average grain size of 2 μm and 1 mass % nanoscale aluminium-scandium precipitates existing in a grain boundary of the aluminium crystal grains and (ii) an external layer (10 μm thick) composed of a metal texture containing copper crystal grains with an average grain size of 1.5 μm. Stranded wires were formed by using the composite strands 39 to 41, and electric wires 39 to 41, each with a cross sectional area of 0.2 $mm^2$, were manufactured by using the stranded wires.

A composite strand 42 with a diameter of 80 μm was manufactured, including (i) an internal layer composed of a metal texture containing aluminium crystal grains with an average grain size of 1.5 μm and 0.1 mass % nanoscale aluminium-scandium precipitates existing in a grain boundary of the aluminium crystal grains and (ii) an external layer (10 μm thick) composed of a metal texture containing copper crystal grains with an average grain size of 1.5 μm. A composite strand 43 with a diameter of 80 μm was manufactured, including (i) an internal layer composed of a metal texture containing aluminium crystal grains with an average grain size of 1.5 μm and 0.5 mass % nanoscale aluminium-scandium precipitates existing in a grain boundary of the aluminium crystal grains and (ii) an external layer (10 μm thick) composed of a metal texture containing copper crystal grains with an average grain size of 1.5 μm. A composite strand 44 with a diameter of 80 μm was manufactured, including (i) an internal layer composed of a metal texture containing aluminium crystal grains with an average grain size of 1.5 μm and 1 mass % nanoscale aluminium-scandium precipitates existing in a grain boundary of the aluminium crystal grains and (ii) an external layer (10 μm thick) composed of a metal texture containing copper crystal grains with an average grain size of 1.5 μm. Stranded wires were formed by using the composite strands 42 to 44, and electric wires 42 to 44, each with a cross sectional area of 0.2 $mm^2$, were manufactured by using the stranded wires.

The same impact force added bending test as in the experimental examples 1 to 6 was conducted on each of the electric wires 39 to 44 at room temperature to obtain the number of cycles to fracture under impact force. Using the manufactured electric wires 39 to 44, conductivities thereof were obtained. Table 16 shows the number of cycles to fracture under impact force and the conductivity obtained. Like the experimental examples 1 to 6, test specimens 39 to 44 having almost the same sectional structure as the composite strands 39 to 44 on average were manufactured to conduct the fatigue tests. A stress at fracture after $10^6$ cycles of cyclic loading was calculated, which was used as the fatigue strength of the internal layer. Tensile specimens 39 to 44 similar to the ones in the experimental examples 1 to 6 were manufactured to obtain tensile strengths. Table 16 shows the fatigue strength and the tensile strength obtained.

TABLE 16

| Experimental Example | Internal Layer: Average Grain Size of Crystal Grains (μm) | Internal Layer: Nanoscale Precipitates (mass %) | External Layer: Average Grain Size of Crystal Grains (μm) | Number of Cycles to Fracture under Impact Force (million cycles) | Conductivity (% IACS) | Fatigue Strength (MPa) | Tensile Strength of External Layer (MPa) |
|---|---|---|---|---|---|---|---|
| 39 | 2 | 0.1 | 1.5 | 3.3 | 68 | 156 | 260 |
| 40 | 2 | 0.5 | 1.5 | 4.5 | 66 | 182 | 260 |
| 41 | 2 | 1 | 1.5 | 3.75 | 60 | 155 | 260 |
| 42 | 1.5 | 0.1 | 1.5 | 3.6 | 67 | 165 | 260 |
| 43 | 1.5 | 0.5 | 1.5 | 5.5 | 65 | 209 | 260 |
| 44 | 1.5 | 1 | 1.5 | 3.7 | 59 | 171 | 260 |

Comparative Examples R95 to R103

A composite strand R95 with a diameter of 80 μm was manufactured, including (i) an internal layer composed of a metal texture containing aluminium crystal grains with an average grain size of 2 μm and 0.05 mass % nanoscale aluminium-scandium precipitates existing in a grain boundary of the aluminium crystal grains and (ii) an external layer (10 μm thick) composed of a metal texture containing copper crystal grains with an average grain size of 1.5 μm. A composite strand R96 with a diameter of 80 μm was manufactured, including (i) an internal layer composed of a metal texture containing aluminium crystal grains with an average grain size of 2 μm and 1.1 mass % nanoscale aluminium-scandium precipitates existing in a grain boundary of the aluminium crystal grains and (ii) an external layer (10 μm thick) composed of a metal texture containing copper crystal grains with an average grain size of 1.5 μm. A composite strand R97 with a diameter of 80 μm was manufactured, including (i) an internal layer composed of a metal texture containing aluminium crystal grains with an average grain size of 1.5 μm and 0.05 mass % nanoscale aluminium-scandium precipitates existing in a grain boundary of the aluminium crystal grains and (ii) an external layer (10 μm thick) composed of a metal texture containing copper crystal grains with an average grain size of 1.5 μm. A composite strand R98 with a diameter of 80 μm was manufactured, including (i) an internal layer composed of a metal texture containing aluminium crystal grains with an average grain size of 1.5 μm and 1.1 mass % nanoscale aluminium-scandium precipitates existing in a grain boundary of the aluminium crystal grains and (ii) an external layer (10 μm thick) composed of a metal texture containing copper crystal grains with an average grain size of 1.5 μm. Stranded wires were formed by using the composite strands R95 to R98, and electric wires R95 to R98, each with a cross sectional area of 0.2 $mm^2$, were manufactured by using the stranded wires.

A composite strand R99 with a diameter of 80 μm was manufactured, including (i) an internal layer composed of a metal texture containing aluminium crystal grains with an average grain size of 2.5 μm and 0.05 mass % nanoscale aluminium-scandium precipitates existing in a grain boundary of the aluminium crystal grains and (ii) an external layer (10 μm thick) composed of a metal texture containing copper crystal grains with an average grain size of 1.5 μm. A composite strand R100 with a diameter of 80 μm was manufactured, including (i) an internal layer composed of a metal texture containing aluminium crystal grains with an average grain size of 2.5 μm and 0.1 mass % nanoscale aluminium-scandium precipitates existing in a grain boundary of the aluminium crystal grains and (ii) an external layer (10 μm thick) composed of a metal texture containing copper crystal grains with an average grain size of 1.5 μm. A composite strand R101 with a diameter of 80 μm was manufactured, including (i) an internal layer composed of a metal texture containing aluminium crystal grains with an average grain size of 2.5 μm and 0.5 mass % nanoscale aluminium-scandium precipitates existing in a grain boundary of the aluminium crystal grains and (ii) an external layer (10 μm thick) composed of a metal texture containing copper crystal grains with an average grain size of 1.5 μm. A composite strand R102 with a diameter of 80 μm was manufactured, including (i) an internal layer composed of a metal texture containing aluminium crystal grains with an average grain size of 2.5 μm and 1 mass % nanoscale aluminium-scandium precipitates existing in a grain boundary of the aluminium crystal grains and (ii) an external layer (10 μm thick) composed of a metal texture containing copper crystal grains with an average grain size of 1.5 μm. A composite strand R103 with a diameter of 80 μm was manufactured from a composite conductor which includes (i) an internal layer composed of a metal texture containing aluminium crystal grains with an average grain size of 2.5 μm and 1.1 mass % nanoscale aluminium-scandium precipitates existing in a grain boundary of the aluminium crystal grains and (ii) an external layer (10 μm thick) composed of a metal texture containing copper crystal grains with an average grain size of 1.5 μm. Stranded wires were formed by using the obtained composite strands R99 to R103 to manufacture electric wires R99 to R103 each having a cross sectional area of 0.2 $mm^2$.

The same impact force added bending test as in the experimental examples 1 to 6 was conducted on each of the electric wires R95 to R103 at room temperature to obtain the number of cycles to fracture under impact force. Using the manufactured electric wires R95 to R103, conductivities thereof were obtained. Table 17 shows the number of cycles to fracture under impact force and the conductivity obtained. Like the experimental examples 1 to 6, test specimens R95 to R103 having almost the same sectional structure as the composite strands R95 to R103 on average were manufactured to conduct the fatigue tests. A stress at fracture after $10^6$ cycles of cyclic loading was calculated, which was used as the fatigue strength of the internal layer. Tensile specimens R95 to R103 similar to the ones in the experimental examples 1 to 6 were manufactured to obtain tensile strengths. Table 17 shows the fatigue strength and the tensile strength obtained.

TABLE 17

| Comparative Example | Internal Layer: Average Grain Size of Crystal Grains (μm) | Internal Layer: Nanoscale Precipitates (mass %) | External Layer: Average Grain Size of Crystal Grains (μm) | Number of Cycles to Fracture under Impact Force (million cycles) | Conductivity (% IACS) | Fatigue Strength (MPa) | Tensile Strength of External Layer (MPa) |
|---|---|---|---|---|---|---|---|
| R95 | 2 | 0.05 | 1.5 | 2.2 | 69 | 130 | 260 |
| R96 | 2 | 1.1 | 1.5 | 2.8 | 57 | 137 | 260 |
| R97 | 1.5 | 0.05 | 1.5 | 2.4 | 69 | 135 | 260 |
| R98 | 1.5 | 1.1 | 1.5 | 2.9 | 56 | 145 | 260 |
| R99 | 2.5 | 0.05 | 1.5 | 1.9 | 70 | 122 | 260 |
| R100 | 2.5 | 0.1 | 1.5 | 1.9 | 68 | 144 | 260 |
| R101 | 2.5 | 0.5 | 1.5 | 2.9 | 66 | 163 | 260 |
| R102 | 2.5 | 1 | 1.5 | 2.8 | 58 | 140 | 260 |
| R103 | 2.5 | 1.1 | 1.5 | 2.6 | 56 | 119 | 260 |

Comparative Examples R104 to R118

A composite strand R104 with a diameter of 80 μm was manufactured, including (i) an internal layer composed of a metal texture containing aluminium crystal grains with an average grain size of 2 μm and 0.05 mass % nanoscale aluminium-scandium precipitates existing in a grain boundary of the aluminium crystal grains and (ii) an external layer (10 μm thick) composed of a metal texture containing copper crystal grains with an average grain size of 2.5 μm. A composite strand R105 with a diameter of 80 μm was manufactured, including (i) an internal layer composed of a metal texture containing aluminium crystal grains with an average grain size of 2 μm and 1.1 mass % nanoscale aluminium-scandium precipitates existing in a grain boundary of the aluminium crystal grains and (ii) an external layer (10 μm thick) composed of a metal texture containing copper crystal grains with an average grain size of 2.5 μm. A composite strand R106 with a diameter of 80 μm was manufactured, including (i) an internal layer composed of a metal texture containing aluminium crystal grains with an average grain size of 2 μm and 0.5 mass % nanoscale aluminium-scandium precipitates existing in a grain boundary of the aluminium crystal grains and (ii) an external layer (10 μm thick) composed of a metal texture containing copper crystal grains with an average grain size of 2.5 μm. A composite strand R107 with a diameter of 80 μm was manufactured, including (i) an internal layer composed of a metal texture containing aluminium crystal grains with an average grain size of 2 μm and 1 mass % nanoscale aluminium-scandium precipitates existing in a grain boundary of the aluminium crystal grains and (ii) an external layer (10 μm thick) composed of a metal texture containing copper crystal grains with an average grain size of 2.5 μm. A composite strand R108 with a diameter of 80 μm was manufactured, including (i) an internal layer composed of a metal texture containing aluminium crystal grains with an average grain size of 2 μm and 1.1 mass % nanoscale aluminium-scandium precipitates existing in a grain boundary of the aluminium crystal grains and (ii) an external layer (10 μm thick) composed of a metal texture containing copper crystal grains with an average grain size of 2.5 μm. Stranded wires were formed by using the composite strands R104 to R108, and electric wires R104 to R108, each with a cross sectional area of 0.2 $mm^2$, were manufactured by using the stranded wires.

A composite strand R109 with a diameter of 80 μm was manufactured, including (i) an internal layer composed of a metal texture containing aluminium crystal grains with an average grain size of 1.5 μm and 0.05 mass % nanoscale aluminium-scandium precipitates existing in a grain boundary of the aluminium crystal grains and (ii) an external layer (10 μm thick) composed of a metal texture containing copper crystal grains with an average grain size of 2.5 μm. A composite strand R110 with a diameter of 80 μm was manufactured, including (i) an internal layer composed of a metal texture containing aluminium crystal grains with an average grain size of 1.5 μm and 1.1 mass % nanoscale aluminium-scandium precipitates existing in a grain boundary of the aluminium crystal grains and (ii) an external layer (10 μm thick) composed of a metal texture containing copper crystal grains with an average grain size of 2.5 μm. A composite strand R111 with a diameter of 80 μm was manufactured, including (i) an internal layer composed of a metal texture containing aluminium crystal grains with an average grain size of 1.5 μm and 0.5 mass % nanoscale aluminium-scandium precipitates existing in a grain boundary of the aluminium crystal grains and (ii) an external layer (10 μm thick) composed of a metal texture containing copper crystal grains with an average grain size of 2.5 μm. A composite strand R112 with a diameter of 80 μm was manufactured, including (i) an internal layer composed of a metal texture containing aluminium crystal grains with an average grain size of 1.5 μm and 1 mass % nanoscale aluminium-scandium precipitates existing in a grain boundary of the aluminium crystal grains and (ii) an external layer (10 μm thick) composed of a metal texture containing copper crystal grains with an average grain size of 2.5 μm. A composite strand R113 with a diameter of 80 μm was manufactured, including (i) an internal layer composed of a metal texture containing aluminium crystal grains with an average grain size of 1.5 μm and 1.1 mass % nanoscale aluminium-scandium precipitates existing in a grain boundary of the aluminium crystal grains and (ii) an external layer (10 μm thick) composed of a metal texture containing copper crystal grains with an average grain size of 2.5 μm. Stranded wires were formed by using the composite strands R109 to R113, and electric wires R109 to R113, each with a cross sectional area of 0.2 $mm^2$, were manufactured by using the stranded wires.

A composite strand R114 with a diameter of 80 μm was manufactured, including (i) an internal layer composed of a metal texture containing aluminium crystal grains with an average grain size of 2.5 μm and 0.05 mass % nanoscale aluminium-scandium precipitates existing in a grain boundary of the aluminium crystal grains and (ii) an external layer (10 μm thick) composed of a metal texture containing copper crystal grains with an average grain size of 2.5 μm. A composite strand R115 with a diameter of 80 μm was manufactured, including (i) an internal layer composed of a metal texture containing aluminium crystal grains with an average grain size of 2.5 μm and 0.1 mass % nanoscale aluminium-scandium precipitates existing in a grain boundary of the aluminium crystal grains and (ii) an external layer (10 μm thick) composed of a metal texture containing copper crystal grains with an average grain size of 2.5 μm. A composite strand R116 with a diameter of 80 μm was manufactured, including (i) an internal layer composed of a metal texture containing aluminium crystal grains with an average grain size of 2.5 μm and 0.5 mass % nanoscale aluminium-scandium precipitates existing in a grain boundary of the aluminium crystal grains and (ii) an external layer (10 μm thick) composed of a metal texture containing copper crystal grains with an average grain size of 2.5 μm. A composite strand R117 with a diameter of 80 μm was manufactured, including (i) an internal layer composed of a metal texture containing aluminium crystal grains with an average grain size of 2.5 μm and 1 mass % nanoscale aluminium-scandium precipitates existing in a grain boundary of the aluminium crystal grains and (ii) an external layer (10 μm thick) composed of a metal texture containing copper crystal grains with an average grain size of 2.5 μm. A composite strand R118 with a diameter of 80 μm was manufactured, including (i) an internal layer composed of a metal texture containing aluminium crystal grains with an average grain size of 2.5 μm and 1.1 mass % nanoscale aluminium-scandium precipitates existing in a grain boundary of the aluminium crystal grains and (ii) an external layer (10 μm thick) composed of a metal texture containing copper crystal grains with an average grain size of 2.5 μm. Stranded wires were formed by using the composite strands R114 to R118, and electric wires R114 to R118, each with a cross sectional area of 0.2 $mm^2$, were manufactured by using the stranded wires.

The same impact force added bending test as in the experimental examples 1 to 6 was conducted on each of the electric wires R104 to R118 at room temperature to obtain the number of cycles to fracture under impact force. Using the manufactured electric wires R104 to R118, conductivities thereof were obtained. Table 18 shows the number of cycles to fracture under impact force and the conductivity obtained. Like the experimental examples 1 to 6, test specimens R104 to R118 having almost the same sectional structure as the composite strands R104 to R118 on average were manufactured to conduct the fatigue tests. A stress at fracture after 106 cycles of cyclic loading was calculated, which was used as the fatigue strength of the internal layer. Tensile specimens R104 to R118 similar to the ones in the experimental examples 1 to 6 were manufactured to obtain tensile strengths. Table 18 shows the fatigue strength and the tensile strength obtained.

TABLE 18

| | Internal Layer | | External Layer | Number of Cycles to | | | |
|---|---|---|---|---|---|---|---|
| Comparative Example | Average Grain Size of Crystal Grains (μm) | Nanoscale Precipitates (mass %) | Average Grain Size of Crystal Grains (μm) | Fracture under Impact Force (million cycles) | Conductivity (% IACS) | Fatigue Strength (Mpa) | Tensile Strength of External Layer (Mpa) |
| R104 | 2 | 0.05 | 2.5 | 1.2 | 70 | 130 | 240 |
| R105 | 2 | 1.1 | 2.5 | 1.6 | 68 | 156 | 240 |
| R106 | 2 | 0.5 | 2.5 | 2.5 | 66 | 182 | 240 |
| R107 | 2 | 1 | 2.5 | 2.0 | 60 | 155 | 240 |
| R108 | 2 | 1.1 | 2.5 | 1.9 | 57 | 137 | 240 |
| R109 | 1.5 | 0.05 | 2.5 | 1.7 | 70 | 135 | 240 |
| R110 | 1.5 | 1.1 | 2.5 | 1.7 | 67 | 165 | 240 |
| R111 | 1.5 | 0.5 | 2.5 | 2.55 | 65 | 209 | 240 |
| R112 | 1.5 | 1 | 2.5 | 2.1 | 59 | 171 | 240 |
| R113 | 1.5 | 1.1 | 2.5 | 2.1 | 56 | 145 | 240 |
| R114 | 2.5 | 0.05 | 2.5 | 1.8 | 70 | 122 | 240 |
| R115 | 2.5 | 0.1 | 2.5 | 2.45 | 68 | 144 | 240 |
| R116 | 2.5 | 0.5 | 2.5 | 2.8 | 66 | 163 | 240 |
| R117 | 2.5 | 1 | 2.5 | 2.7 | 58 | 140 | 240 |
| R118 | 2.5 | 1.1 | 2.5 | 2.5 | 56 | 119 | 240 |

According to the results shown in Tables 14 to 18, it was found that the conductivity was 59% IACS or more and the number of cycles to fracture under impact force was three million times or more when the fatigue strength of the internal layer (subjected to 10' cycles of the cyclic loading) was 150 MPa or more and the tensile strength of the external layer was 250 MPa or 260 MPa in the composite conductor including the internal layer composed of the metal texture containing the aluminium crystal grains with the average grain size of 2 μm or less and 0.1 to 1 mass % of the nanoscale aluminium-scandium precipitates existing in the grain boundary of the aluminium crystal grains and the external layer composed of the metal texture containing the copper crystal grains with the average grain size of 2 μm or less. Thus, when the electric wire manufactured by using this composite conductor is used for, for example, wiring of a drive member of an industrial robot, the reliability of the robot can be improved and a burden of maintenance can be reduced.

The present invention is described hereinabove referring to the embodiments. The present invention is not limited to the above-described embodiments, but can include modifications within a scope of the present invention.

For example, the conductive material B is the copper silver alloy in the first to fourth embodiments, but can be copper, a copper tin alloy, or a copper nickel alloy. In the forth embodiment, 0.1 mass % or more but not exceeding 20 mass % of nanoparticles D including any one of fullerene, carbon nanotube, a silicon nanoparticle, a transition metal nanoparticle, and a compound nanoparticle composed of a compound of a metal forming the conductive material B can exist in the grain boundary of the crystal grains of the metal texture forming the conductive material B.

In the fifth embodiment, the conductive material B is the silver-based alloy, but can be silver.

In the fifth embodiment, the conductive material A can be formed by a metal texture including crystal grains of copper or a copper-based alloy with an average grain size of 2 μm or less. Also, the conductive material A can be formed by a metal texture including crystal grains of aluminium or an aluminium-based alloy with an average grain size of 2 μm or less and the nanoparticles C existing in the grain boundary of the crystal grains.

The nanoparticles C is the nanoscale aluminium-scandium precipitates, but can be fullerene, carbon nanotube, a silicon nanoparticle, a transition metal nanoparticle, and a compound nanoparticle composed of a compound of a metal forming the conductive material A. In this case, preferably, the nanoparticles C is 0.1 mass % or more but not exceeding 20 mass %.

In the first to fifth embodiments, the composite rod to form the composite conductor is fabricated by coating the rod forming the internal layer with the tape material forming the external layer and mechanically pressure-welding the rod and the tape, but can be fabricated by providing a thick plating layer made of the same material as the tape material on a surface of the rod. Further, the composite rod can be fabricated by extruding two layers by using the same material as the rod and the same material as the tape material.

INDUSTRIAL APPLICABILITY

A composite conductor and an electric wire using the same according to the present invention has fracture resistance to a sudden load fluctuation or impact as well as high bending durability. Thus, the composite conductor and the electric wire using the same can be used for wiring of industrial robots, consumer robots, or a variety of transporting machines, particularly for wiring of driving parts or vibrating parts subjected to cyclic bending. Thus, a breaking of the electric wire in use can be avoided, improving reliabilities of the robot and the various transporting machines. As a result, maintenance costs of the robot and the various transporting machines can be decreased and further operational costs thereof can be reduced.

REFERENCE SIGNS LIST

10: composite conductor, 11: internal layer, 12: external layer, 13: crystal grain, 14: grain boundary, 15: crystal grain, 16: grain boundary, 17: composite conductor, 18: internal layer, 19: crystal grain, 20: grain boundary, 21: nanoscale precipitate, 22: composite conductor, 23: internal layer, 24: crystal grain, 25: grain boundary, 26: nanoscale precipitate

The invention claimed is:

1. A composite conductor, comprising:

an internal layer comprising a conductive material A, the conductive material A having fatigue strength of at least 150 MPa after being subjected to $10^6$ cycles of cyclic loading in a fatigue test; and an external layer comprising a conductive material B, the external layer coating the internal layer, the conductive material B having tensile strength higher than that of the conductive material A, the tensile strength being at least 250 MPa;

wherein the composite conductor has fracture resistance to a sudden load and impact as well as bending durability.

2. The composite conductor according to claim 1, wherein the conductive material A comprises a metal texture including (i) a crystal grain of aluminium or an aluminium-based alloy, the crystal grain having an average grain size of 2 μm or less, and (ii) a nanoparticle C existing in a grain boundary between the crystal grains, and wherein the conductive material B comprises a metal texture including a crystal grain of copper or a copper-based alloy, the crystal grain having an average grain size of 2 μm or less.

3. The composite conductor according to claim 2, wherein the nanoparticle C comprises any one of fullerene, carbon nanotube, a silicon nanoparticle, a transition metal nanoparticle, and a compound nanoparticle including a compound of a metal forming the conductive material A, the nanoparticle C being 0.1 mass % or more but not exceeding 20 mass %.

4. The composite conductor according to claim 2, wherein the nanoparticle C is a nanoscale aluminium-scandium precipitate, the nanoscale precipitate being 0.1 mass % or more but not exceeding 1 mass %.

5. The composite conductor according to claim 2, wherein the conductive material A comprises the aluminium-based alloy and the aluminium-based alloy further comprises 0.1 mass % or more but not exceeding 0.2 mass % of zirconium.

6. The composite conductor according to claim 2, wherein the metal texture of the conductive material A comprises 20% or more of the crystal grains by cross sectional area with a grain size of 1 μm or less.

7. The composite conductor according to claim 2, wherein the conductive material B comprises the copper-based alloy, and the copper-based alloy is any one of a copper silver alloy, a copper tin alloy, and a copper nickel alloy.

8. The composite conductor according to claim 1, wherein the conductive material A comprises a metal texture including a crystal grain of copper, the crystal grain having an average grain size of 2 μm or less, wherein the conductive material B comprises a metal texture including a crystal grain of a copper-based alloy, the crystal grain having an average grain size of 2 μm or less, and wherein a strength ratio $\sigma_B/\sigma_A$ of tensile strength $\sigma_B$ of the conductive material B to tensile strength $\sigma_A$ of the conductive material A is 1.6 or more.

9. The composite conductor according to claim 8, wherein 0.1 mass % or more but not exceeding 20 mass % of a nanoparticle D exists in a grain boundary of the crystal grains in the metal texture forming the conductive material B.

10. The composite conductor according to claim 9, wherein the nanoparticle D comprises any one of fullerene, carbon nanotube, a silicon nanoparticle, a transition metal nanoparticle, and a compound nanoparticle comprising a compound of a metal forming the conductive material B.

11. An electric wire made of the composite conductor according to claim 1, comprising:

a composite strand having a diameter of 0.05 mm or more but not exceeding 0.5 mm, wherein the electric wire is used as an electric wire for wiring a drive member for a robot.

12. A composite conductor, comprising:

an internal layer comprising a conductive material A, the conductive material A having fatigue strength of at least 150 MPa after being subjected to $10^6$ cycles of cyclic loading in a fatigue test; and an external layer comprising a conductive material B, the external layer coating the internal layer, the conductive material B having tensile strength higher than that of the conductive material A, the tensile strength being at least 150 MPa;

wherein the composite conductor has bending durability.

13. The composite conductor according to claim 12, wherein the conductive material A comprises a metal texture including (i) a crystal grain of aluminium, the crystal grain having an average grain size of 2 μm or less, and (ii) a nanoscale aluminium-scandium precipitate existing in a grain boundary between the crystal grains, the nanoscale precipitate being 0.1 mass % or more but not exceeding 1 mass % and wherein the conductive material B comprises a metal texture including a crystal grain of silver or a silver-based alloy, the crystal grain having an average grain size of 2 μm or less.

14. The composite conductor according to claim 12, wherein the conductive material A comprises a metal texture including a crystal grain of copper or a copper-based alloy, the crystal grain having an average grain size of 2 μm or less, and wherein the conductive material B comprises a metal texture including a crystal grain of silver or a silver-based alloy, the crystal grain having an average grain size of 2 μm or less.

15. The composite conductor according to claim 12, wherein the conductive material A comprises a metal texture including (i) a crystal grain of aluminium or an aluminium-based alloy, the crystal grain having an average grain size of 2 μm or less, and (ii) a nanoparticle C existing in a grain boundary between the crystal grains, wherein the conductive material B comprises a metal texture including a crystal grain of silver or a silver-based alloy, the crystal grain having an average grain size of 2 μm or less, and wherein the nanoparticle C comprises any one of fullerene, carbon nanotube, a silicon nanoparticle, a transition metal nanoparticle, and a compound nanoparticle including a compound of a metal forming the conductive material A, the nanoparticle C being 0.1 mass % or more but not exceeding 20 mass %.

16. An electric wire made of the composite conductor according to claim 12, comprising:

a composite strand having a diameter of 0.05 mm or more but not exceeding 0.5 mm, wherein the electric wire is used as an electric wire for wiring an automobile or an aircraft.

* * * * *